US010801156B2

(12) United States Patent
Pollett et al.

(10) Patent No.: US 10,801,156 B2
(45) Date of Patent: Oct. 13, 2020

(54) WASHING MACHINE APPLIANCES AND METHODS OF PUMP OPERATION

(71) Applicant: Haier US Appliance Solutions, Inc., Wilmington, DE (US)

(72) Inventors: James Quentin Pollett, Louisville, KY (US); Darrin R. Smith, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 93 days.

(21) Appl. No.: 16/005,766

(22) Filed: Jun. 12, 2018

(65) Prior Publication Data

US 2019/0376224 A1 Dec. 12, 2019

(51) Int. Cl.

| | |
|---|---|
| ***D06F 39/08*** | (2006.01) |
| ***D06F 37/24*** | (2006.01) |
| ***D06F 37/12*** | (2006.01) |

(52) U.S. Cl.

CPC ..... *D06F 39/083* (2013.01); *D06F 37/12* (2013.01); *D06F 37/24* (2013.01); *D06F 39/087* (2013.01)

(58) Field of Classification Search

CPC ..... D06F 37/203; D06F 39/082–085

See application file for complete search history.

(56) References Cited

U.S. PATENT DOCUMENTS

| | | | | |
|---|---|---|---|---|
| 6,609,264 | B2 | 8/2003 | Ruhl et al. | |
| 6,654,975 | B2 | 12/2003 | Broker | |
| 7,694,373 | B2 | 4/2010 | Kwon et al. | |
| 2016/0289882 | A1* | 10/2016 | Song | G06F 3/14 |
| 2017/0298553 | A1 | 10/2017 | Dunn et al. | |
| 2017/0298555 | A1 | 10/2017 | Davis | |
| 2018/0016728 | A1 | 1/2018 | Davis | |

FOREIGN PATENT DOCUMENTS

| | | |
|---|---|---|
| CN | 1566499 | 1/2005 |
| CN | 101153442 | 4/2008 |
| CN | 102031666 | 4/2011 |
| CN | 105887414 | 8/2016 |
| CN | 106868785 | 6/2017 |
| JP | H09122376 | 5/1997 |

OTHER PUBLICATIONS

International Search Report, PCT Application No. PCT/CN2019/090880, dated Sep. 11, 2019, 4 pages.

* cited by examiner

*Primary Examiner* — Spencer E Bell
(74) *Attorney, Agent, or Firm* — Dority & Manning, P.A.

(57) ABSTRACT

Washing machine appliances and methods of operating a pump thereof are provided herein. The washing machine appliance may include a tub, a basket, a nozzle, a measurement device mounted to the tub, a motor, a drain pump, and a controller. The basket may be rotatably mounted within the tub. The nozzle may be in fluid communication with the tub to selectively flow liquid thereto. The motor may be in mechanical communication with the basket to selectively rotate the basket within the tub. The drain pump may be in fluid communication with the tub to selectively motivate wash fluid therefrom. The controller may be operative communication with the measurement device, the motor, and the drain pump. The controller may be configured to initiate a washing operation.

20 Claims, 13 Drawing Sheets

WASHING MACHINE APPLIANCES AND METHODS OF PUMP OPERATION

FIELD OF THE INVENTION

The present subject matter relates generally to washing machine appliances, such as vertical axis washing machine appliances, and methods for controlling a pump thereof.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

Washing machine appliances include vertical axis washing machine appliances and horizontal axis washing machine appliances, where "vertical axis" and "horizontal axis" refer to the axis of rotation of the wash basket within the tub. Vertical axis washing machine appliances typically have the tub suspended in the cabinet with suspension devices. The suspension devices generally allow the tub to move relative to the cabinet during operation of the washing machine appliance.

In conventional washing machine appliances, a drain or spin cycle is often performed for a predetermined amount of time. The predetermined amount of time may be set, for instance, by a user or by selecting a specified load size or article type. A pump may continue to actively drain or run for the predetermined amount of time. However, such appliances and methods often fail to account for the variations in unique loads or collections of articles within a wash basket. For instance, it may be difficult to know in advance how an actual load (e.g., individual load) of articles provided by a user will be affected during a given washing operation. The provided articles may be a unique mixture of fabrics of varying volumes and mass. Moreover, it may be difficult for a user to guess what setting is appropriate for an individual load. Thus, a predetermined amount of time for a drain or spin cycle may be inappropriate for certain loads.

Undesirable operation may result from an inappropriate drain or spin cycle. For instance, if the drain or spin cycle is too brief, the articles within wash basket will remain excessively wet (e.g., such that water continues to drip from the articles when removed from the washing machine appliance). If the drain or spin cycle is too long, excessive energy may be expended by the washing machine appliance. In addition, undesired noise may be generated, especially if a pump assembly runs dry (i.e., continues to pump without any water or liquid to flow therethrough).

Accordingly, improved methods and assemblies for controlling drain operations of a washing machine appliance are desired. In particular, it would be advantageous to provide methods and assemblies to monitor and influence drain operations based on one or more detected characteristics of an individual load.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method may include flowing a volume of liquid into a tub, and activating a drain pump for an active pumping period to motivate at least a portion of the volume of liquid from the tub. The method may further include measuring movement of the tub during the active pumping period, and determining the measured movement exceeds a movement threshold. The method may still further include deactivating the drain pump in response to determining the measured movement exceeds the movement threshold.

In another exemplary aspect of the present disclosure, a washing machine appliance is provided. The washing machine appliance may include a tub, a basket, a nozzle, a measurement device mounted to the tub, a motor, a drain pump, and a controller. The basket may be rotatably mounted within the tub. The nozzle may be in fluid communication with the tub to selectively flow liquid thereto. The motor may be in mechanical communication with the basket to selectively rotate the basket within the tub. The drain pump may be in fluid communication with the tub to selectively motivate wash fluid therefrom. The controller may be operative communication with the measurement device, the motor, and the drain pump. The controller may be configured to initiate a washing operation. The washing operation may include flowing a volume of liquid into the tub, activating the drain pump for an active pumping period to motivate at least a portion of the volume of liquid from the tub, measuring movement of the tub during the active pumping period, determining the measured movement exceeds a movement threshold, and deactivating the drain pump in response to determining the measured movement exceeds the movement threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
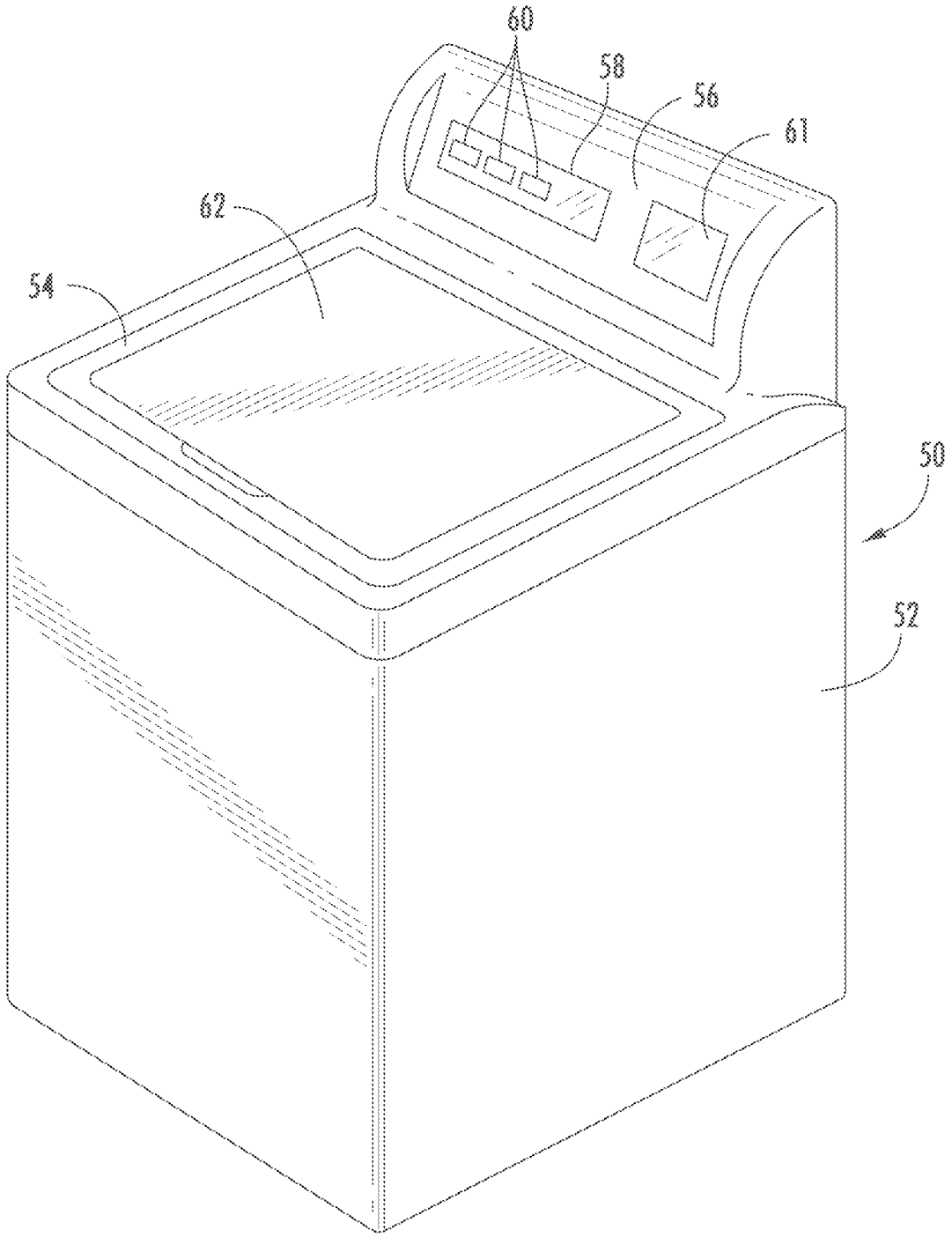
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

It is noted that, for the purposes of the present disclosure, the terms "includes" and "including" are intended to be inclusive in a manner similar to the term "comprising." Similarly, the term "or" is generally intended to be inclusive (i.e., "A or B" is intended to mean "A or B or both").

Figure 2:
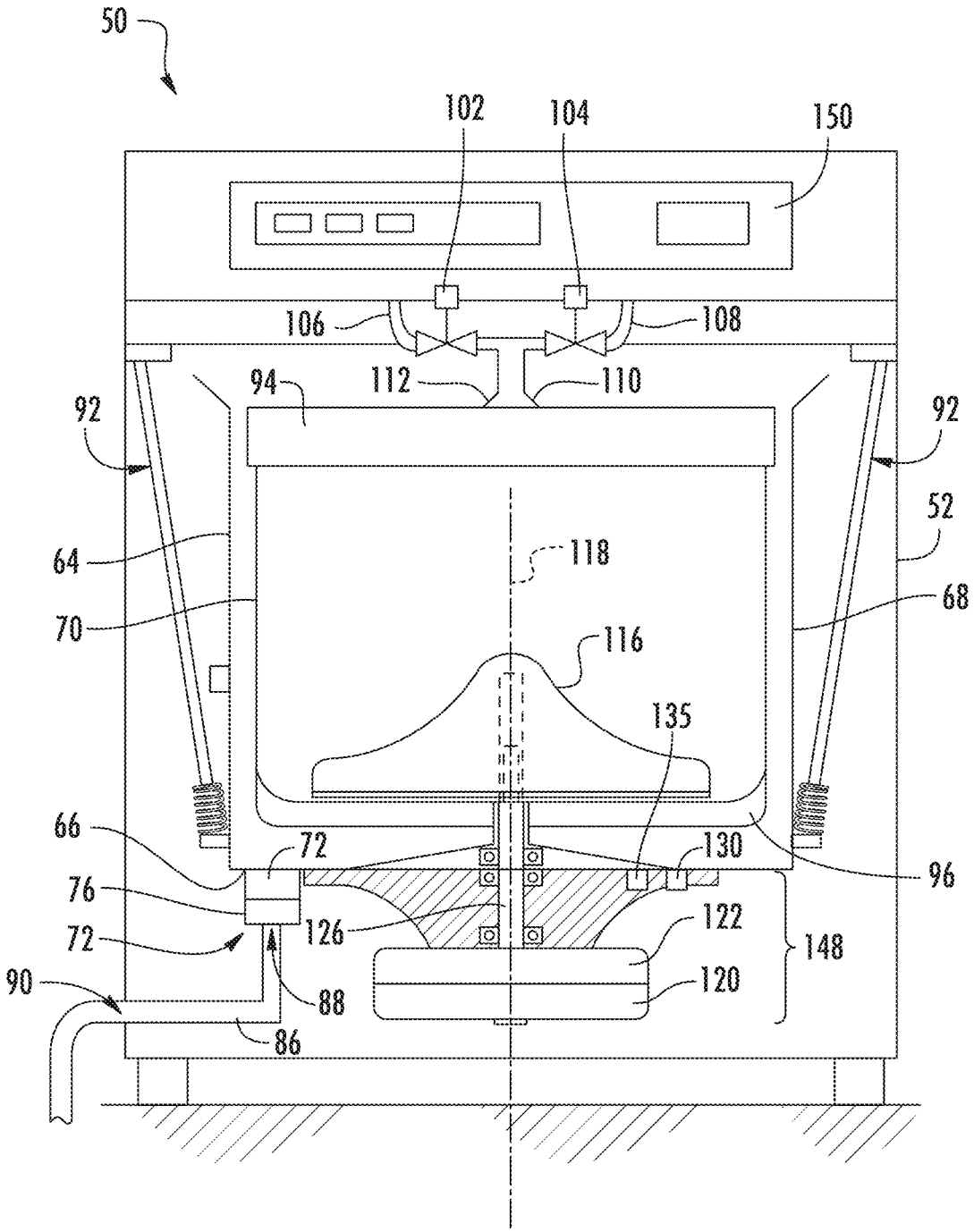
FIG. 2 provides a front elevation schematic view of various components of the exemplary washing machine appliance of FIG. 1.

Turning now to the figures, FIG. 1 provides a perspective view of a washing machine appliance 50 according to an exemplary embodiment of the present disclosure. FIG. 2 provides a front elevation schematic view of certain components of washing machine appliance 50.

As shown, washing machine appliance 50 includes a cabinet 52 and a cover 54. In some embodiments, a backsplash 56 extends from cover 54, and a control panel 58, including a plurality of input selectors 60, is coupled to backsplash 56. Control panel 58 and input selectors 60 collectively form a user interface input for operator selection of machine cycles and features, and in certain embodiments a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming an enclosure over tub 64.

As illustrated in FIGS. 1 and 2, washing machine appliance 50 is a vertical axis washing machine appliance. While the present disclosure is discussed with reference to an exemplary vertical axis washing machine appliance, those of ordinary skill in the art, using the disclosures provided herein, should understand that the subject matter of the present disclosure is equally applicable to other washing machine appliances or configurations.

Generally, tub 64 includes a bottom wall 66 and a sidewall 68. Moreover, a basket 70 is rotatably mounted within tub 64. In some embodiments, a drain pump or pump assembly 72 is located beneath tub 64 and basket 70 for gravity assisted flow when draining tub 64. As would be understood, pump assembly 72 includes a pump 74 and a motor 76. In some embodiments, pump assembly 72, including motor 76, is mounted or attached to tub 64. For instance, pump assembly 72 may be fixed to tub 64 at bottom wall 66. A pump inlet hose or channel may extend from a tub outlet defined in tub bottom wall 66 to a pump inlet. A pump outlet hose 86 may extend from a pump outlet 88 to an appliance fluid outlet 90 and, ultimately to a building plumbing system discharge line (not shown) in fluid communication with outlet 90.

Generally, wash basket 70 is movably disposed and rotatably mounted in tub 64 in a spaced apart relationship from tub side wall 68 and tub bottom 66. Basket 70 includes a plurality of perforations therein to facilitate fluid communication between an interior of basket 70 and tub 64.

In some embodiments, a hot liquid valve 102 and a cold liquid valve 104 deliver liquid, such as water, to basket 70 and tub 64 through a respective hot liquid hose 106 and cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown), may also be provided to produce a liquid or wash solution by mixing fresh water with a known detergent or other additive for cleansing of articles in basket 70.

In some embodiments, an agitation element 116, such as a vane agitator, impeller, auger, or oscillatory basket mechanism (or some combination thereof) is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within tub 64.

Clutch system 122 facilitates driving engagement of basket 70 and agitation element 116 for rotatable movement within tub 64, and clutch system 122 facilitates relative rotation of basket 70 and agitation element 116 for selected portions of wash cycles. Motor 120 and transmission and clutch system 122 collectively are referred herein as a motor assembly 148.

Figure 3:
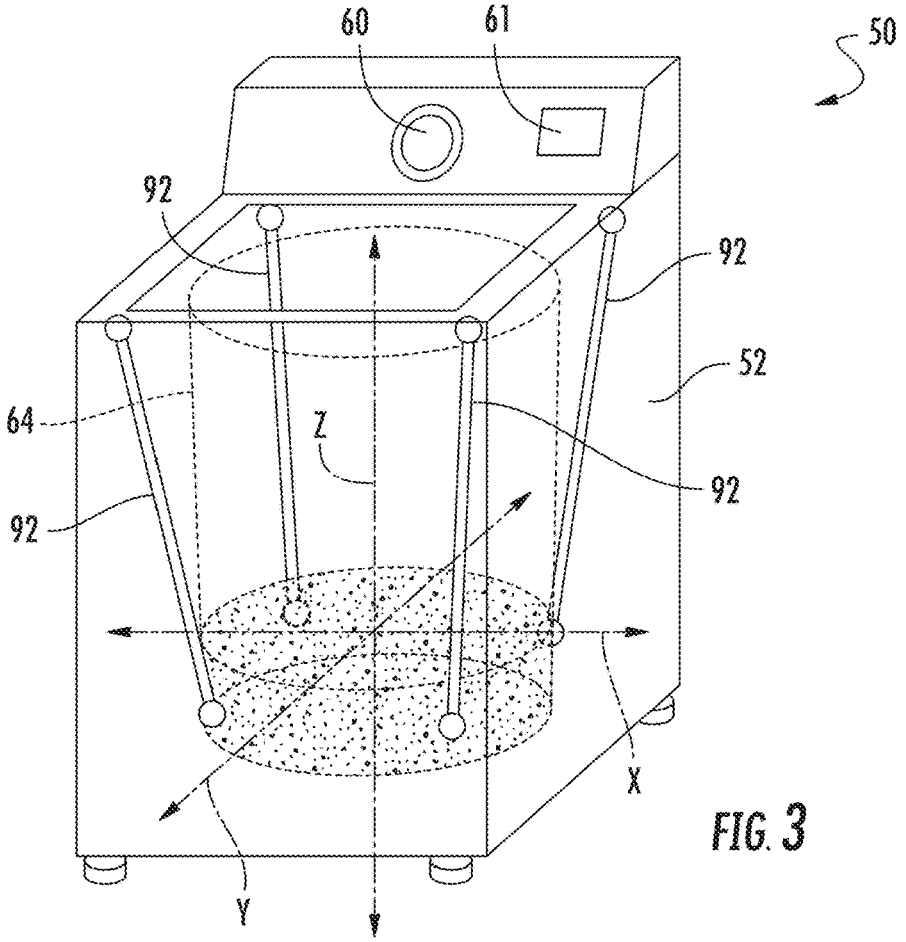
FIG. 3 provides a perspective schematic view of components of a washing machine appliance in accordance with embodiments of the present disclosure.
Figure 4:
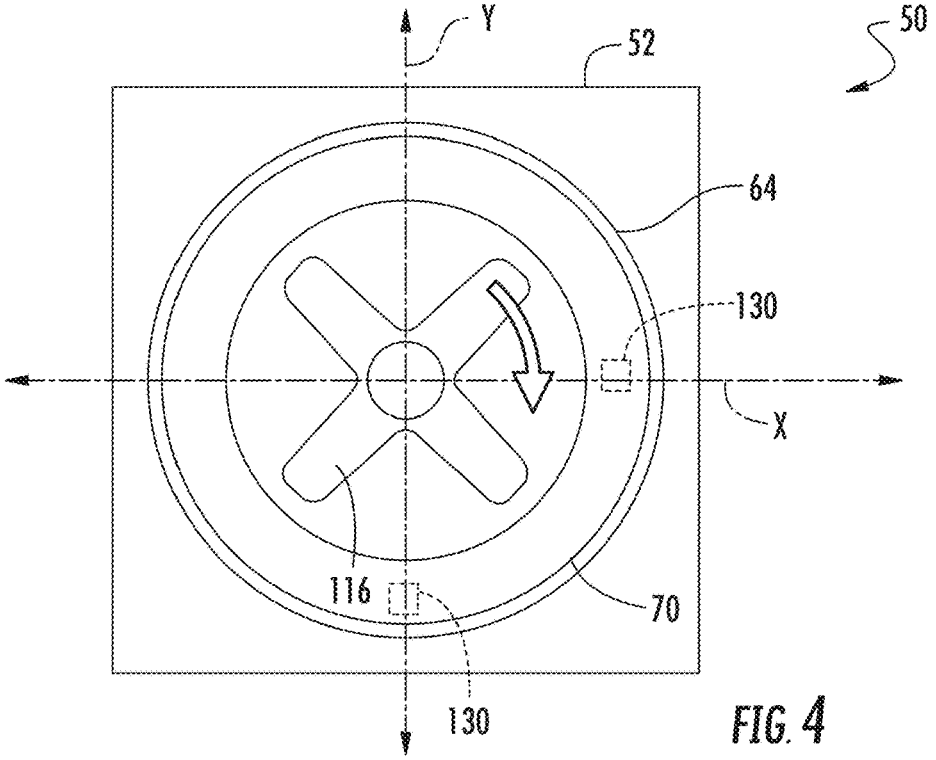
FIG. 4 provides a top view of an agitation element, basket, and tub within a cabinet of a washing machine appliance in accordance with embodiments of the present disclosure.

Referring now to FIGS. 2 through 4, basket 70, tub 64, pump assembly 72, and motor assembly 148 are supported by a vibration dampening suspension system. The dampening suspension system can include one or more suspension assemblies 92 coupled between and to the cabinet 52 and tub 64. Typically, four suspension assemblies 92 are utilized, and are spaced apart about the tub 64. For example, each suspension assembly 92 may be connected at one end proximate a corner of the cabinet 52 and at an opposite end to the tub 64. The washer can include other vibration dampening elements, such as a balance ring 94 disposed around the upper circumferential surface of the wash basket 70. The balance ring 94 can be used to counterbalance an out of balance condition for the wash machine as the basket 70 rotates within the tub 64. The wash basket 70 could also include a balance ring 96 located at a lower circumferential surface of the wash basket 70.

Operation of washing machine appliance 50 is controlled by a controller 150 that is operatively coupled (e.g., electrically coupled or connected) to a user interface (e.g., user interface 58) located on washing machine backsplash 56 (FIG. 1) for user manipulation to select washing machine cycles and features. In response to user manipulation of the user interface (e.g., inputs thereof), controller 150 operates the various components of washing machine appliance 50 to execute selected machine cycles and features.

Controller 150 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 150 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 58 and other components of washing machine appliance 50, such as motor assembly 148, pressure sensor 135, and measurement devices 130 (discussed herein) may be in communication with controller 150 via one or more signal lines, shared communication busses, or wireless networks to provide signals to or receive signals from the controller 150. Optionally, a measurement device 130 may be included with controller 150. Moreover, measurement devices 130 may include a microprocessor that performs the calculations specific to the measurement of motion with the calculation results being used by controller 150.

In some embodiments, a pressure sensor 135 is provided in operative communication with tub 64. For instance, pressure sensor may communicate with the tub 64 through the bottom wall 66. Pressure sensor 135 may be configured to detect or measure pressure within the tub 64. In particular, pressure sensor 135 may detect or measure pressure generated by the liquid held within tub 64 (e.g., during a wash cycle). In some such embodiments, pressure signals detected at pressure sensor 135 may be transmitted to and received by controller 150. Controller 150 may be configured to determine the pressure within tub 64 (or the volume of liquid therein) based on the received pressure signals. As would be understood, pressure sensor 135 may be formed as any suitable pressure detecting device, such as a piezoresitive, capacitive, electromagnetic, piezoelectric, or optical pressure detecting device.

In an illustrative embodiment, laundry items or articles are loaded into basket 70, and a washing operation is initiated through operator manipulation of control input selectors 60 (shown in FIG. 1). Tub 64 is filled with liquid, such as water, and mixed with detergent to form a wash fluid. Basket 70 is agitated with agitation element 116 (e.g., as part of an agitation phase of a wash cycle) for cleansing of laundry items in basket 70. That is, agitation element 116 is moved back and forth in an oscillatory back and forth motion about vertical axis 118, while basket 70 remains generally stationary (i.e., not actively rotated). In the illustrated embodiment, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72 (e.g., as part of a drain phase). Laundry articles can then be rinsed by again adding liquid to tub 64. Depending on the particulars of the cleaning cycle selected by a user, agitation element 116 may again provide agitation within basket 70. After a rinse cycle, tub 64 is again drained, such as through use of pump assembly 72 (e.g., as part of another drain phase). After liquid is drained from tub 64, one or more spin cycles may be performed. In particular, a spin cycle may be applied after the agitation phase or after the rinse phase in order to wring excess wash fluid from the articles being washed, as will be further described below. During a spin cycle, basket 70 is rotated at one or more relatively high speeds about vertical axis 118, such as between approximately 450 and approximately 1300 revolutions per minute.

Referring now to FIGS. 3 and 4, one or more measurement devices 130 may be provided in the washing machine appliance 50 for measuring movement of the tub 64, in particular during at least a portion of a washing operation, such as when pump assembly 72 is active or basket 70 rotates. As will be described in greater detail below, movement may be measured as one or more rotation or acceleration components (see FIGS. 5 through 8), detected at the one or more measurement devices 130. Measurement devices 130 may measure a variety of suitable variables, which can be correlated to movement of the tub 64. The movement measured by such devices 130 can be utilized to monitor the operation or state of the pump assembly 72, in particular a wash cycle, and to advantageously prevent excessive noise or energy from being generated during the washing operation.

A measurement device 130 in accordance with the present disclosure may include an accelerometer which measures translational motion, such as acceleration along one or more directions. Additionally or alternatively, a measurement device 130 may include a gyroscope, which measures rotational motion, such as rotational velocity about an axis. A measurement device 130 in accordance with the present disclosure is mounted to the tub 64 (e.g., bottom wall 66 or a sidewall 68 thereof) to sense movement of the tub 64 relative to the cabinet 52 by measuring uniform periodic motion, non-uniform periodic motion, or excursions of the tub 64 during appliance 50 operation. Advantageously, measurement device 130 may be positioned or mounted along a common plane (e.g., defined by bottom wall 66) with pump assembly 72. During use, movement may be detected or measured as discrete identifiable components (e.g., in a predetermined plane or direction).

Optionally, a measurement device 130 may be or include an accelerometer, which measures translational motion (e.g., as an acceleration component), such as acceleration along one or more directions. Additionally or alternatively, a measurement device 130 may be or include a gyroscope, which measures rotational motion (e.g., as a rotation component), such as rotational velocity about a predetermined axis. Additionally or alternatively, a measurement device 130 may be or include an optical sensor, an inductive sensor, a Hall Effect sensor, a potentiometer, a load cell, a strain gauge, or any other suitable device capable of measuring, either directly or indirectly, translational or rotational movement of tub 64. A measurement device 130 in accordance with the present disclosure can be mounted to the tub 64 (i.e. bottom wall 66 or a sidewall 68 thereof), the basket 70, or the cabinet 52, as required to sense movement of the tub 64 relative to the cabinet 52. In particular exemplary embodiments, such as when accelerometers or gyroscopes are utilized, the accelerometers or gyroscopes may be mounted to the tub 64.

In exemplary embodiments, a measurement device 130 may include at least one gyroscope or at least one accelerometer. The measurement device 130, for example, may be a printed circuit board which includes the gyroscope and accelerometer thereon. The measurement device 130 may be mounted to the tub 64 (e.g., via a suitable mechanical fastener, adhesive, etc.) and may be oriented such that the various sub-components (e.g., the gyroscope and accelerometer) are oriented to measure movement along or about particular directions as discussed herein. In certain embodiments, at least one measurement device 130 is mounted to bottom wall 66 or otherwise positioned in a plane parallel to the pump assembly 72.

Notably, the gyroscope and accelerometer in exemplary embodiments are advantageously mounted to the tub 64 at a single location (e.g., the location of the printed circuit board or other component of the measurement device 130 on which the gyroscope and accelerometer are grouped). Such positioning at a single location advantageously reduces the costs and complexity (e.g., due to additional wiring, etc.) of detecting or measuring movements to the tub 64 caused by the pump assembly 72, while still providing relatively accurate movement detection as discussed herein. Alternatively, however, the gyroscope and accelerometer need not be mounted at a single location. For example, a gyroscope located at one location on tub 64 can measure the rotation of a gyroscope located at a different location on tub 64, because rotation about a given axis is the same everywhere on a solid object such as tub 64.

As illustrated in FIGS. 3 and 4, tub 64 may define an X-axis, a Y-axis, and a Z-axis that are mutually orthogonal to each other. The Z-axis may extend along a longitudinal direction, and may thus be coaxial or parallel with the vertical axis 118 when the tub 64 and basket 70 are balanced. Movement of the tub 64 measured by measurement devices 130 (such as a rotation component or acceleration component of such movement) may, in exemplary embodiments, be an indirect or direct measurement of rotation or oscillation of tub 64 (e.g., about the Z-axis). Such movement may, for example, be measured in a plane defined by the X-axis and Y-axis.

Figure 5:
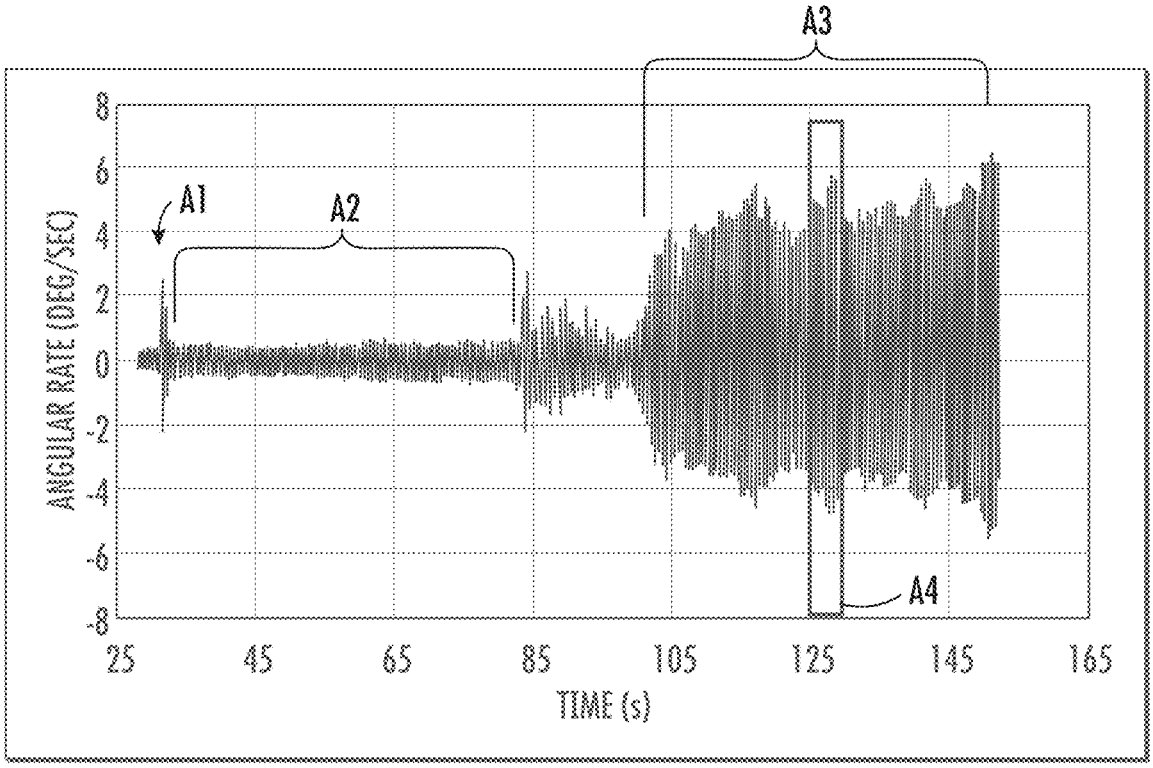
FIG. 5 provides a graph illustrating a measured angular movement rate relative to time across a washing operation for a tub of an exemplary washing machine appliance of the present disclosure.
Figure 6:
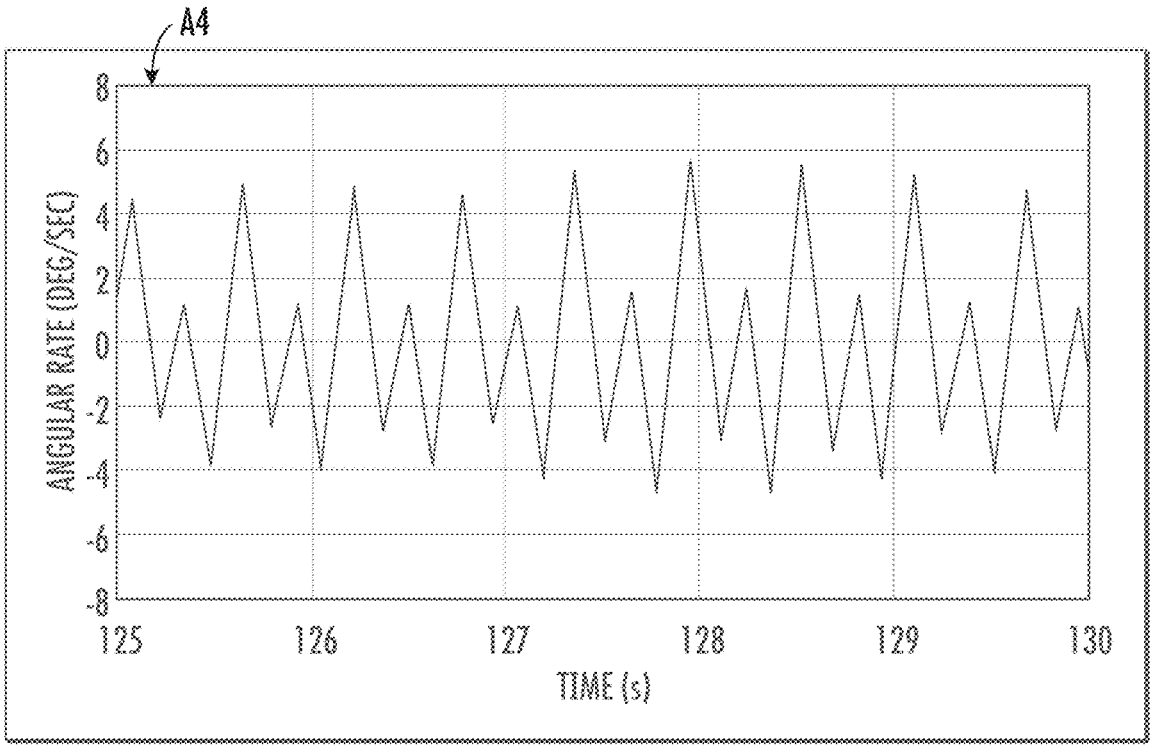
FIG. 6 provides a graph illustrating a sub-portion of the graph of FIG. 5.

Turning to FIGS. 5 and 6, multiple measurements recorded during a portion of an exemplary washing operation (e.g., wash cycle) are illustrated. In particular, FIGS. 5 and 6 illustrate a recorded rotation component of the measured movement (e.g., in degrees of rotation over time) relative to a period of time (e.g., in seconds). Thus, the measured movement of the tub 64 (FIG. 3) may include a rotation component (e.g., detected at the gyroscope of measurement device 130—FIG. 4) of tub 64 about the Z-axis. In optional embodiments, the raw data detected at the measurement device 130 may be selectively filtered (e.g., to reduce noise or interference received at the measurement device 130). For example, one or more dominant frequency attributable to the pump assembly 72 may be identified or determined in advance from testing results of prototype model. In some instances, the dominant frequency or frequencies may be detectable by a relatively high power frequency ratio (e.g., dB/Hz) at one or more specific frequencies detected at, for instance, the gyroscope of the measurement device 130. During certain washing operations, a bandpass filter may be applied to the frequencies or signals detected at the measurement device 130, thereby restricting measured movement to the dominant frequency or frequencies. As would be understood, the measured movement, including values thereof, may be recorded over time (e.g., at controller 150—FIG. 2).

As generally illustrated in FIGS. 5 and 6, various portions or characteristics of a washing operation (e.g., during a drain phase of a wash cycle) of a washing machine appliance 50 (FIG. 2) may be detected or identified according to a rotation component (e.g., angular rate in degrees per second) over time (e.g., in seconds). For instance, a sudden initial spike or increase in the angular rate (e.g., A1) may indicate that the pump assembly has been activated (e.g., to pump water or wash fluid from the tub). A subsequent time span or period of relatively low angular rates (e.g., A2) may indicate that the pump assembly is actively motivating water or wash fluid from the tub. A further subsequent time span or period of relatively high angular rates (e.g., A3) may indicate that the pump assembly 72 is running dry. A sub-portion (A4) of the period A3 is shown in greater detail at FIG. 6. Optionally, the rotation component may be detected at the gyroscope of the measurement device 130 (FIG. 2).

Figure 7:
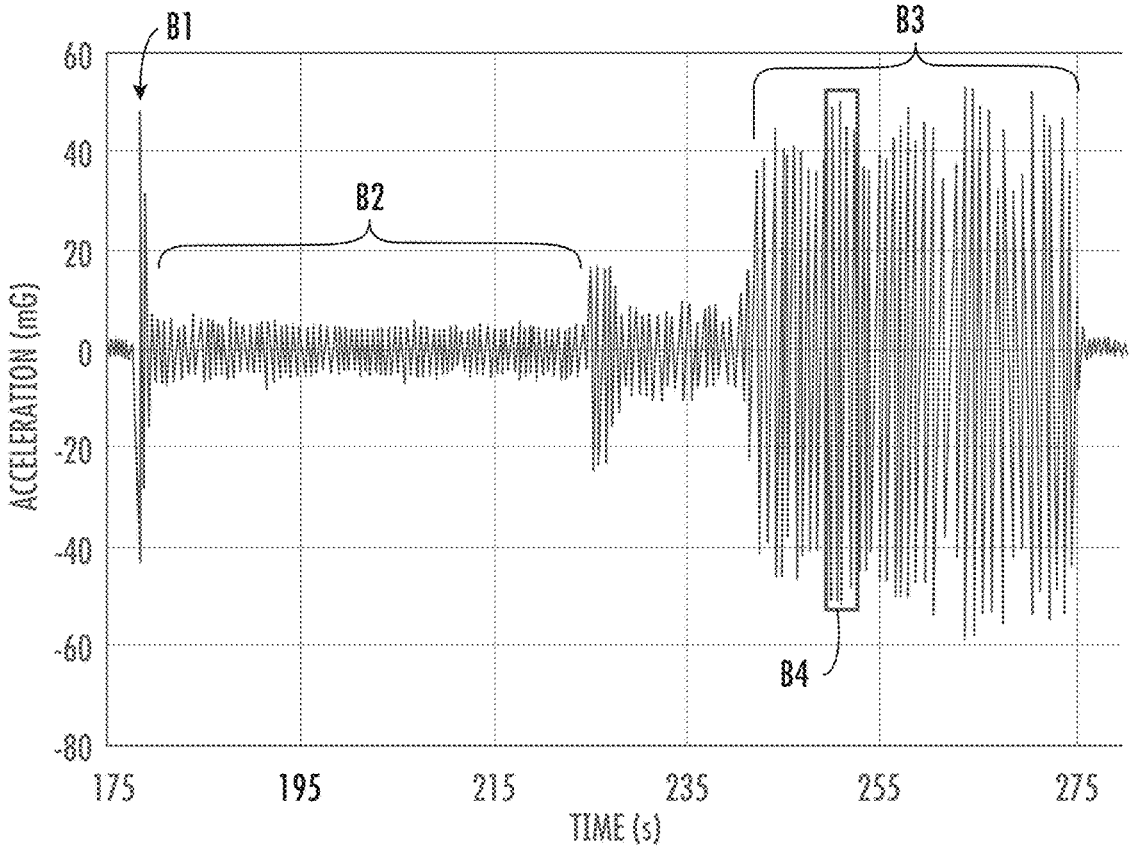
FIG. 7 provides a graph illustrating a measured acceleration relative to time across a wash cycle for a tub of an exemplary washing machine appliance of the present disclosure.
Figure 8:
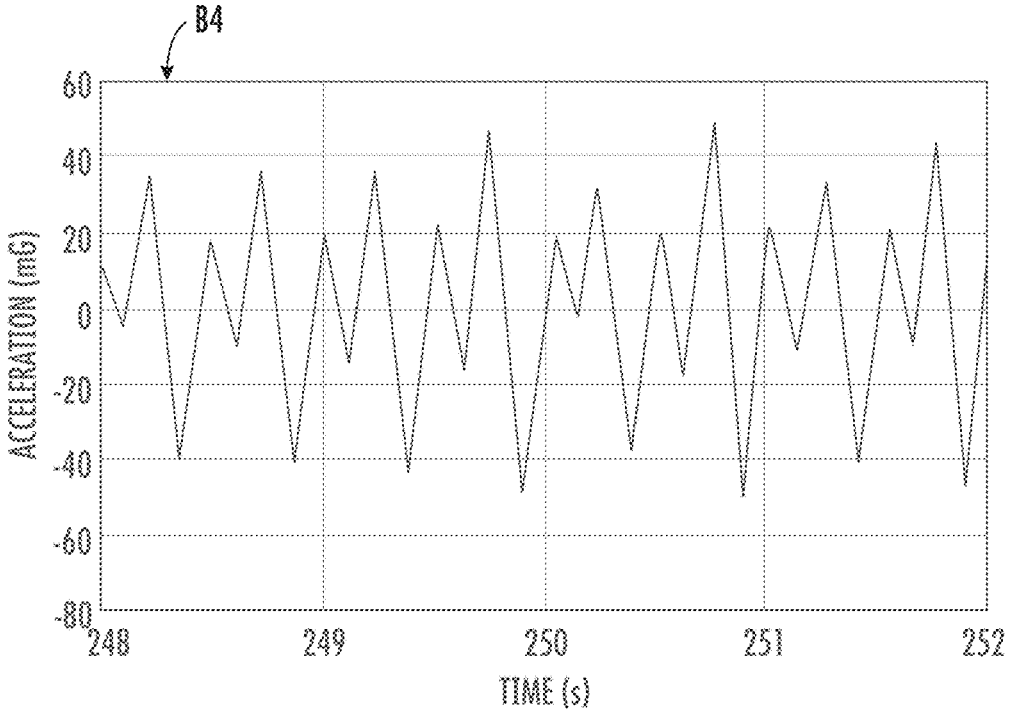
FIG. 8 provides a graph illustrating a sub-portion of the graph of FIG. 7.

Turning to FIGS. 7 and 8, multiple measurements recorded during a portion of an exemplary wash operation (e.g., wash cycle) are illustrated. In particular, FIGS. 7 and 8 illustrate a recorded acceleration component of the measured movement (e.g., in mG) relative to a period of time (e.g., in seconds). Thus, the measured movement of the tub 64 (FIG. 2) may include an acceleration component (e.g., detected at the accelerometer of measurement device 130—FIG. 4) of tub 64 perpendicular to the Z-axis. As would be understood, the measured movement, including values thereof, may be recorded over time (e.g., at controller 150—FIG. 2).

As generally illustrated in FIGS. 7 and 8, various portions or characteristics of a washing operation (e.g., during a drain phase of a wash cycle) may be detected or identified according to an acceleration component (e.g., acceleration in mG) over time (e.g., in seconds). For instance, a sudden initial spike or increase in the acceleration (e.g., B1) may indicate the pump assembly has been activated (e.g., to pump water or wash fluid from the tub). A subsequent time span or period of relatively low acceleration (e.g., B2) may indicate that the pump assembly is actively motivating water or wash fluid from the tub. A further subsequent time span or period of relatively high acceleration (e.g., B3) may indicate that the pump assembly is running dry. A sub-portion (B4) of the period B3 is shown in greater detail at FIG. 8. Optionally, the acceleration component may be detected at the accelerometer of the measurement device 130 (FIG. 2).

Referring now to FIGS. 9 through 16, various methods may be provided for use with washing machine appliances (e.g., washing machine appliance 50—FIG. 2) in accordance with the present disclosure. In general, the various steps of methods as disclosed herein may, in exemplary embodiments, be performed by the controller 150 as part of a washing operation that the controller 150 is configured to initiate (e.g., a wash cycle, a rinse cycle, a spin cycle, etc.). During such methods, controller 150 may receive inputs and transmit outputs from various other components of the appliance 50. For example, controller 150 may send signals to and receive signals from motor assembly 148 (including the motor 120), control panel 58, one or more measurement device 130, pump assembly 72, pressure sensor 135, or valves 102, 104. In particular, the present disclosure is further directed to methods, as indicated by reference numbers 200, 300, 400, 500, 600, 700, 800, and 900, for operating washing machine appliance. Such methods advantageously reduce cycle times and noise generated during a washing operation.

As would be understood, although FIGS. 9 through 16 illustrate multiple exemplary steps, it is understood that, except as otherwise indicated, none of the exemplary embodiments of FIGS. 9 through 16 are mutually exclusive. In other words, various steps or features of one or more exemplary embodiments may be incorporated into one or more other embodiments.

Figure 9:
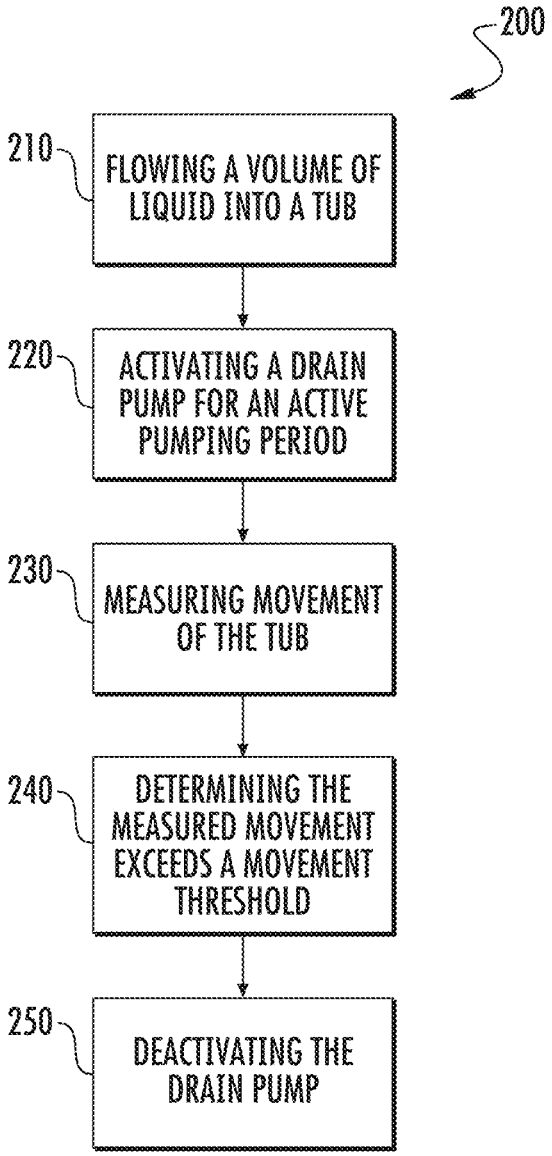
FIG. 9 provides a flow chart illustrating a method for operating a washing machine appliance in accordance with exemplary embodiments of the present disclosure.

Turning specifically to FIG. 9, a method 200 is illustrated. At 210, the method 200 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 220, the method 200 includes activating the drain pump or pump assembly for an active pumping period (e.g., period of time) to motivate at least a portion of the volume of liquid from the tub. As described above, the pump (e.g., impeller thereof) may be rotated by the motor to draw liquid (e.g., water or wash fluid) from the tub. In some such embodiments, 220 follows 210 or another cycle, such as a wash cycle, rinse cycle, etc. Before 220, articles within the tub may be agitated prior to halting all movement (e.g., of the wash basket or agitator) within the cabinet and calibrating the measurement device.

In optional embodiments, movement (e.g., preliminary movement) is measured immediately upon initiation of the active pumping period at 220. The measured preliminary movement may be compared to a predetermined startup movement threshold. Generally, the preliminary movement threshold may be set to indicate a spike in tub movement caused by the pump assembly. Thus, the determination that the measured preliminary movement exceeds the predetermined preliminary movement threshold may indicate the pump assembly is functioning as intended. Activation of the drain pump may be maintained in response to such a determination. By contrast, a determination that the measured preliminary movement does not exceed the predetermined preliminary movement threshold may indicate a defect or error with the pump assembly. In response, the drain pump may be deactivated or an error message may be presented at the user interface. Additionally or alternatively, an error message may be recorded (e.g., locally within the controller of the appliance) or transmitted remotely (e.g., to a remote technician or server in wireless communication with the appliance).

At 230, the method 200 includes measuring movement of the tub (e.g., after a predefined period or amount of time has expired following initiation of the active pumping period of 220). Generally, 230 may occur during at least a portion of 220, concurrently with or subsequent to liquid within tub being pumped through the pump assembly. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 240 includes receiving a measurement signal corresponding to movement of the tub as the drain pump remains active (e.g., continues to motivate liquid from the tub).

In certain embodiments, measured movement includes a tub acceleration component. The tub acceleration component may be measured during the active pumping period of 220 based on an acceleration signal received from the accelerometer mounted to the tub with the measurement device. Additionally or alternatively, the accelerometer may be mounted on a common plane with the drain pump (e.g., a plane defined by the X-axis and Y-axis, as described above). For instance, both the accelerometer and drain pump may be mounted to the bottom wall of the tub.

In additional or alternative embodiments, measured movement includes a tub rotation component. The tub rotation component may be measured during 220 based on a rotation signal received from the gyroscope mounted to the tub with the measurement device. Additionally or alternatively, the gyroscope may be mounted on a common plane with the drain pump (e.g., a plane defined by the X-axis and Y-axis, as described above). For instance, both the gyroscope and drain pump may be mounted to the bottom wall of the tub.

At 240, the method 200 includes determining the measured movement at 230 exceeds a movement threshold (e.g., a dry pump movement threshold that is unique from preliminary movement threshold). The determination of 240 may be made during an evaluation of the measured movement performed during at least a portion of 220. In other words, the determination of 240 may be made while the drain pump is active. Moreover, the determination that 240 may generally indicate that a significant portion of liquid is drained from the tub and that the drain pump may be running dry.

In embodiments wherein measuring movement includes a tub acceleration component, the movement threshold may be or include a predetermined acceleration value. The determination at 240 may include comparing the tub acceleration component to the predetermined acceleration value. For instance, 240 may require that the tub acceleration component exceed the predetermined acceleration value.

In embodiments wherein measuring movement includes a rotation component, the movement threshold may be or include a predetermined rotation value. The determination at 240 may include comparing the rotation component to the predetermined rotation value. For instance, 240 may require that the rotation component exceed the predetermined rotation value.

At 250, the method 200 includes deactivating the drain pump. In some embodiments, 250 is initiated in response to 240 (i.e., in response to determining the measured movement exceeds the movement threshold). In some embodiments, the drain pump is kept in a deactivated state for at least predetermined inactive period. Optionally, the predetermined inactive period may be a set amount of time in excess of ten seconds (e.g., 11 seconds, 20 seconds, 30 seconds, etc.). In certain embodiments, the drain pump remains inactive following expiration of the predetermined inactive period. Additionally or alternatively, the wash basket may be rotated (e.g., according to a spin cycle) at a relatively high velocity (e.g., successor rotation velocity) following expiration of the predetermined inactive period. As would be understood, the relatively high velocity may be in velocity at which articles within the wash basket would be fully plastered to the sidewalls of the wash basket (e.g., equal to or greater than 1000 RPM). Additional liquid may be permitted to accumulate within the bottom of the tub as the drain pump remains deactivated.

In optional embodiments, the method 200 may include confirming a significant portion of the liquid has drained from the tub following 250 (e.g., following expiration of the predetermined inactive period).

As an example, the method 200 may include measuring pressure (e.g., liquid pressure) within the tub at the pressure sensor after the drain pump is deactivated. The measured pressure generally corresponds to the volume of liquid remaining within the tub. Moreover, measured pressure may be compared to a pressure threshold. If the measured pressure is determined to exceed the pressure threshold (i.e. in response to such a determination), at least some liquid may remain in the tub and the drain pump may be reactivated (e.g., for a limited reactivation time period) to drain the remaining liquid. If the measured pressure is determined not to exceed the pressure threshold, the drain pump may be held in the inactive state (i.e., remain deactivated).

As another example, the method 200 may include measuring a motor current or amperage at the motor rotating the wash basket after the drain pump is deactivated. The measured current or amperage may be compared to a current threshold. If the measured current or amperage is determined to exceed the current threshold (i.e. in response to such a determination), at least some liquid may remain in the tub and the drain pump may be reactivated (e.g., for a limited reactivation time period) to drain the remaining liquid. If the measured current or amperage is determined not to exceed the current threshold, the drain pump may be held in the inactive state (i.e., remain deactivated).

In some embodiments, method 200 includes repeatedly evaluating measured movement. For instance, measurements of movement made by the tub while the drain pump is active may be compared to the movement threshold repeatedly, such as in a closed loop (e.g., before 240). In some embodiments, the measured movement at 230 is not the first measured movement but a second (or later) measured movement. The method 200 may thus include determining that a measured movement (e.g., first or earlier measured movement subsequent to 220) does not exceed the movement threshold prior to 240. In response, the drain pump may remain active to motivate liquid from the tub. Movement may be subsequently measured (e.g., as a second or later measured movement) and again compared to the movement threshold. Moreover, the steps may be repeated, for instance, until 250 is met or the washing operation is otherwise halted.

In additional or alternative embodiments, deactivation of the drain pump at 250 is maintained for the predetermined inactive period. Following expiration of the predetermined inactive period, the drain pump may be reactivated for a secondary active pumping period (e.g., a time period between 10 seconds and 60 seconds). During the secondary active pumping period, subsequent movement of the tub may be measured. The measured subsequent movement may be compared to the movement threshold. If it is determined that the measured subsequent movement exceeds the movement threshold, the drain pump may be again deactivated (e.g., for a secondary inactive period). If it is determined that the measured subsequent movement does not exceed the movement threshold, liquid may remain within the tub and the drain pump may continue to pump liquid in in the active state (e.g., until the measured subsequent movement exceeds the movement threshold or a washing operation is otherwise halted).

Figure 10:
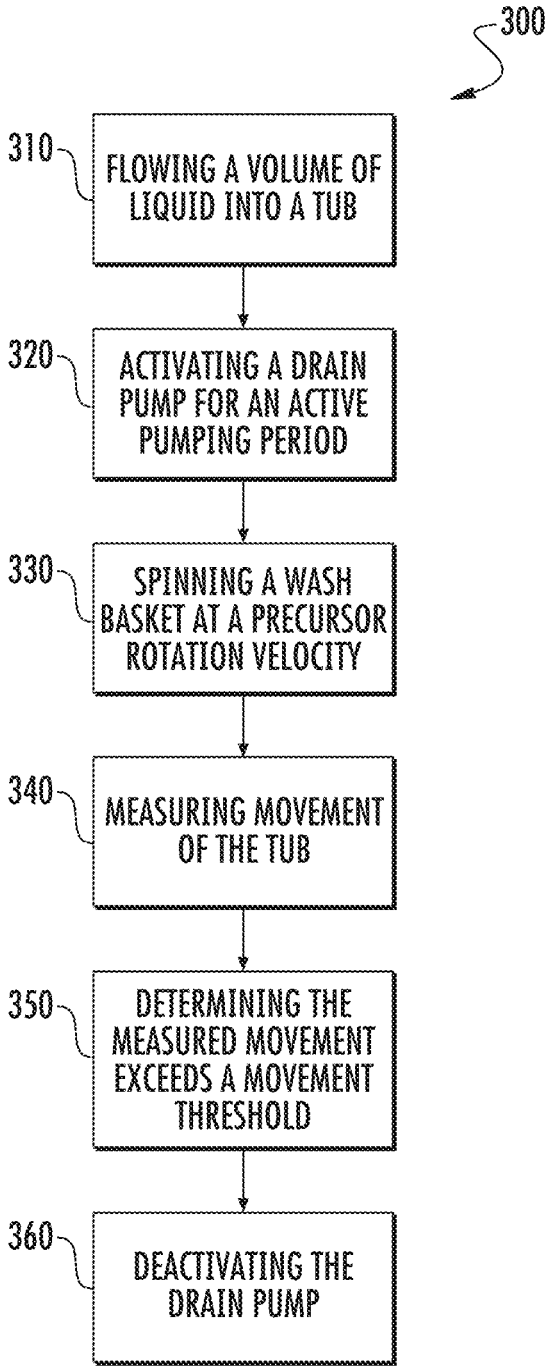
FIG. 10 provides a flow chart illustrating another method for operating a washing machine appliance in accordance with exemplary embodiments of the present disclosure.

Turning specifically to FIG. 10, a method 300 is illustrated. At 310, the method 300 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 320, the method 300 includes activating the drain pump or pump assembly for an active pumping period (e.g., period of time) to motivate at least a portion of the volume of liquid from the tub. As described above, the pump (e.g., impeller thereof) may be rotated by the motor to draw liquid (e.g., water or wash fluid) from the tub. In some such embodiments, 320 follows 310 or another cycle, such as a wash cycle, rinse cycle, etc. Before 320, articles within the tub may be agitated prior to halting all movement (e.g., of the wash basket or agitator) within the cabinet and calibrating the measurement device.

At 330, the method 300 includes spinning the wash basket at a precursor rotation velocity (e.g., while the drain pump is active). In certain embodiments, 330 begins after activating drain pump (e.g., subsequent to the start of 320). In additional or alternative embodiments, spinning at 330 begins prior to the start of 320, but continues subsequent to the start of 320 (e.g., while the drain pump is active). During at least a portion of 330, the drain pump may continue to operate such that an impeller of the pump is rotated to motivate water from the tub. Generally, the precursor rotation velocity is a predetermined velocity [e.g., defined in rotations per minute (RPM)] for rotating the wash basket about rotation axis. Moreover, the precursor rotation velocity may be a sub-shedding velocity (e.g., above 5 RPM). In other words, the precursor rotation velocity may be a velocity at which articles within the wash basket would not be fully plastered to the sidewalls of the wash basket. In certain embodiments, precursor rotation velocity is less than 1000 RPM.

In optional embodiments, multiple precursor rotation velocities are provided. In some such embodiments, 330 includes spinning the wash basket at progressively higher precursor rotation velocities. As an example, three or more progressively higher precursor rotation velocities may be provided (e.g., 140 RPM, 450 RPM, 800 RPM). In some such embodiments, the wash basket spins at 140 RPM for a set period. The wash basket may then spin at 450 RPM for another set period. Subsequent to spinning at 450 RPM (and thereby subsequent to spinning at 140 RPM), the wash basket may spin at 800 RPM for yet another set period. Optionally, each of the set periods may include a predetermined span of time (e.g., in seconds). Additionally or alternatively, each of the set periods may be equal to each other.

At 340, the method 300 includes measuring movement of the tub. In particular, 340 is performed during the active pumping period. Additionally or alternatively, 340 may be performed while the wash basket spins at the precursor rotation velocity or velocities. In other words, 340 may be performed during at least a portion of 330 or 320). As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 340 includes receiving a measurement signal corresponding to movement of the tub as the drain pump remains active (e.g., continues to motivate liquid from the tub).

In certain embodiments, measured movement includes a tub acceleration component. The tub acceleration component may be measured during 320 or 330 based on an acceleration signal received from the accelerometer mounted to the tub with the measurement device. Additionally or alternatively, the accelerometer may be mounted on a common plane with the drain pump (e.g., a plane defined by the X-axis and Y-axis, as described above). For instance, both the accelerometer and drain pump may be mounted to the bottom wall of the tub.

In additional or alternative embodiments, measured movement includes a tub rotation component. The tub rotation component may be measured during 320 or 330 based on a rotation signal received from the gyroscope mounted to the tub with the measurement device. Additionally or alternatively, the gyroscope may be mounted on a common plane with the drain pump (e.g., a plane defined by the X-axis and Y-axis, as described above). For instance, both the gyroscope and drain pump may be mounted to the bottom wall of the tub.

At 350, the method 300 includes determining the measured movement at 340 exceeds a movement threshold. The determination of 350 may be made during an evaluation of the measured movement performed during at least a portion of 320 or 330. In other words, the determination of 350 may be made while the drain pump is active or while the wash basket continues to spin or rotate at one or more of the precursor velocities.

In embodiments wherein measuring movement includes a tub acceleration component, the movement threshold may be or include a predetermined acceleration value. The determination at 350 may include comparing the tub acceleration component to the predetermined acceleration value. For instance, 350 may require that the tub acceleration component exceed the predetermined acceleration value.

In embodiments wherein measuring movement includes a rotation component, the movement threshold may be or include a predetermined rotation value. The determination at 350 may include comparing the rotation component to the predetermined rotation value. For instance, 350 may require that the rotation component exceed the predetermined rotation value.

At 360, the method 300 includes deactivating the drain pump. In some embodiments, 360 is initiated in response to 350 (i.e., in response to determining the measured movement exceeds the movement threshold). In some embodiments, the drain pump is kept in a deactivated state for at least predetermined inactive period. Optionally, the predetermined inactive period may be a set amount of time in excess of ten seconds (e.g., 11 seconds, 20 seconds, 30 seconds, etc.). In certain embodiments, the drain pump remains inactive following expiration of the predetermined inactive period. Additionally or alternatively, the wash basket may be spun or rotated (e.g., according to a spin cycle) at a relatively high velocity (e.g., a shedding or successor rotation velocity that is greater than the precursor velocity or velocities) following expiration of the predetermined inactive period. As would be understood, the relatively high velocity may be in velocity at which articles within the wash basket would be fully plastered to the sidewalls of the wash basket (e.g., equal to or greater than 1000 RPM).

In optional embodiments, the method 300 may include confirming a significant portion of the liquid has drained from the tub following 360 (e.g., following expiration of the predetermined inactive period).

As an example, the method 300 may include measuring pressure (e.g., liquid pressure) within the tub at the pressure sensor after the drain pump is deactivated. The measured pressure generally corresponds to the volume of liquid remaining within the tub. Moreover, measured pressure may be compared to a pressure threshold. If the measured pressure is determined to exceed the pressure threshold (i.e. in response to such a determination), at least some liquid may remain in the tub and drain pump may be reactivated (e.g., for a limited reactivation time period). If the measured pressure is determined not to exceed the pressure threshold, the drain pump may be held in the inactive state.

As another example, the method 300 may include measuring a motor current or amperage at the motor rotating the wash basket after the drain pump is deactivated. The measured current or amperage may be compared to a current threshold. If the measured current or is determined to exceed the current threshold (i.e. in response to such a determination), at least some liquid may remain in the tub and drain pump may be reactivated (e.g., for a limited reactivation time period). If the measured current or amperage is determined not to exceed the current threshold, the drain pump may be held in the inactive state.

In some embodiments, method 300 includes repeatedly evaluating measured movement. For instance, measurements of movement made by the tub while the drain pump is active may be compared to the movement threshold repeatedly, such as in a closed loop (e.g., before 350). In some embodiments, the measured movement at 340 is not the first measured movement but a second (or later) measured movement. The method 300 may thus include determining that a measured movement (e.g., first or earlier measured movement subsequent to 320) does not exceed the movement threshold prior to 350. In response, the drain pump may remain active to motivate liquid from the tub. The wash basket may be prevented from spinning at the successor velocity (or at all). Movement may be subsequently measured (e.g., as a second or later measured movement) and again compared to the movement threshold. Moreover, the steps may be repeated, for instance, until 360 is met or the washing operation is otherwise halted.

In additional or alternative embodiments, deactivation of the drain pump at 360 is maintained for the predetermined inactive period. Following expiration of the predetermined inactive period, the drain pump may be reactivated for a secondary active pumping period (e.g., a time period between 10 seconds and 60 seconds). During the secondary active pumping period, subsequent movement of the tub may be measured. The measured subsequent movement may be compared to the movement threshold. If it is determined that the measured subsequent movement exceeds the movement threshold, the drain pump may be again deactivated (e.g., for a secondary inactive period). If it is determined that the measured subsequent movement does not exceed the movement threshold, liquid may remain within the tub and the drain pump may continue to pump liquid in the active state (e.g., until the measured subsequent movement exceeds the movement threshold or a washing operation is otherwise halted).

Figure 11:
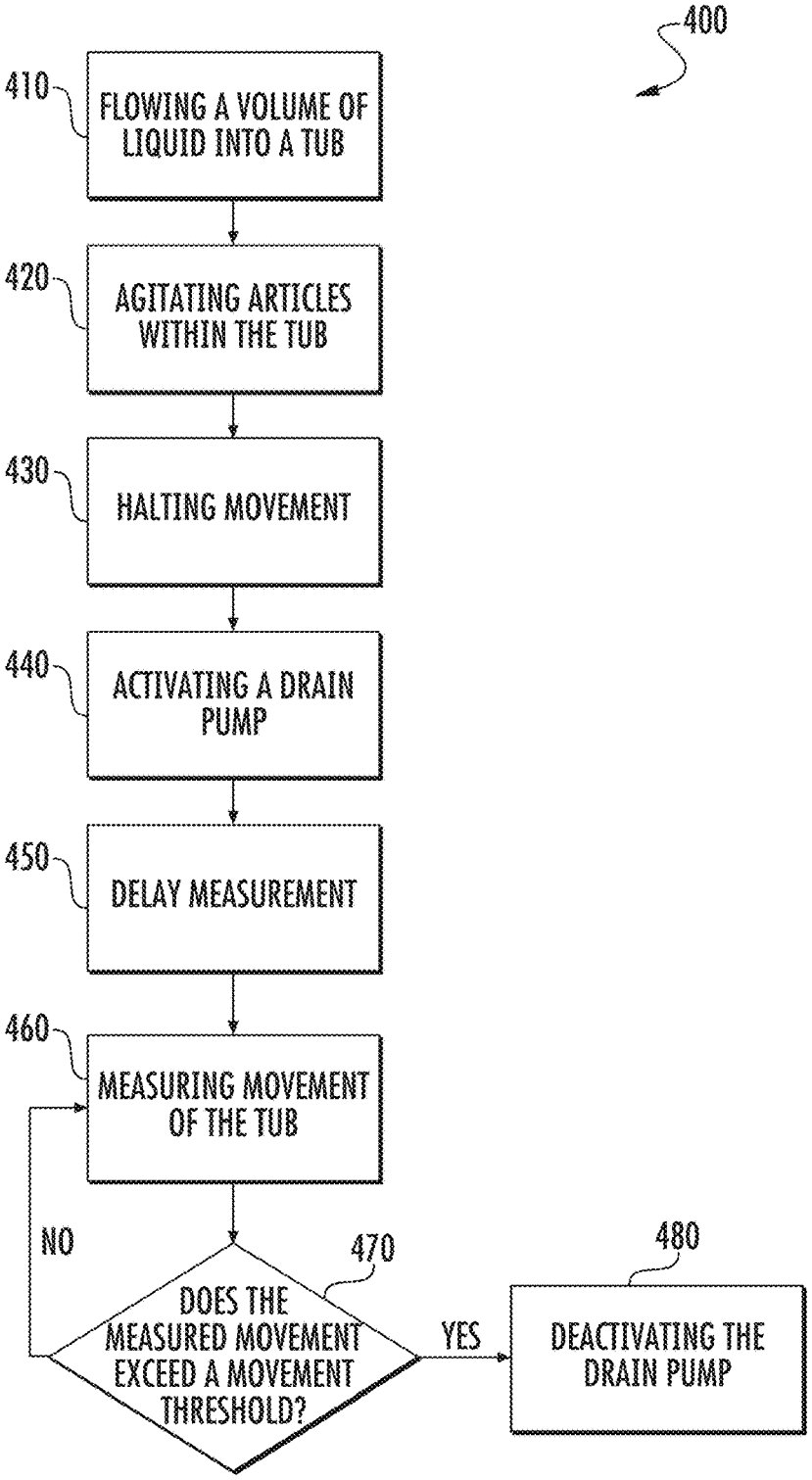
FIG. 11 a flow chart illustrating yet another method for operating a washing machine appliance in accordance with exemplary embodiments of the present disclosure.

Turning specifically to FIG. 11, a method 400 is illustrated. At 410, the method 400 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 420, the method 400 includes agitating articles within the tub (e.g., disposed within the wash basket) for a set period of time. Agitating may be performed by agitation element as discussed above. During such agitation, the volume of liquid flowed into the tub in step 410 remains in the tub (e.g., no drainage of liquid may occur between steps 410 and 420). Optionally, the period of time for 420 is a defined period of time programmed into the controller, and may be dependent upon the size of the load of articles and other variables that may, for example, be input by a user interacting with the control panel and input selectors thereof.

At 430, the method 400 includes halting movement within the cabinet of the washing machine appliance. In other words, the basket and agitator are prevented from moving. Thus, at 430 the agitation at 420 is stopped. However, the volume of liquid within the tub may remain. In certain embodiments, the measurement device mounted to the bottom of the tub is calibrated while the wash basket is halted. As would be understood, a zero rate or zero G-level bias at the measurement device may be offset.

At 440, the method 400 includes activating the drain pump or pump assembly to motivate at least a portion of the volume of liquid from the tub. As described above, the pump (e.g., impeller thereof) may be rotated by the motor to draw liquid (e.g., water or wash fluid) from the tub.

At 450, the method 400 includes delaying measurement following activation of the drain pump at 440. For instance, 450 may include counting down from a pump warm-up or delay period (e.g., a predetermined span of time between 1 second and 10 seconds, such as 3 seconds). The method 400 may be prevented from continuing to step 460 until the warm-up or delay period has expired. Additionally or alternatively, 450 may include initiating a pump confirmation sequence (e.g., as described below with respect to method 600). The method 400 may be prevented from continuing to step 460 until the pump confirmation sequence is complete. Optionally, initiation of the pump confirmation sequence may occur immediately after the warm-up or delay period has expired. In some embodiments, activation of the drain pump (e.g., step 440) continues throughout 450.

At 460, the method 400 includes measuring movement of the tub (e.g., after 450). Generally, 460 may occur during at least a portion of 440, concurrently with or subsequent to liquid within tub being pumped through the pump assembly. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 460 includes receiving a measurement signal corresponding to movement of the tub as the drain pump remains active (e.g., continues to motivate liquid from the tub).

At 470, the method 400 includes evaluating measured movement. In particular, the measured movement (e.g., the tub acceleration component or the rotation component) is compared to the movement threshold. Evaluation of 470 may be performed as the drain pump remains active. If measured movement does not exceed the movement threshold, movement may be measured again (i.e., the method 400 may return to 460). The drain pump may be maintained in an active state (e.g., to motivate or pump liquid from the tub). Optionally, 460 may be repeated (e.g., as a closed loop) such that subsequent movement measurements continue to be made as long as movement does not exceed the movement threshold. If measured movement does exceed the movement threshold, the method 400 may continue to 480.

At 480, the method 400 includes deactivating the drain pump in response to 470 (i.e., in response to determining the measured movement exceeds the movement threshold).

Figure 12:
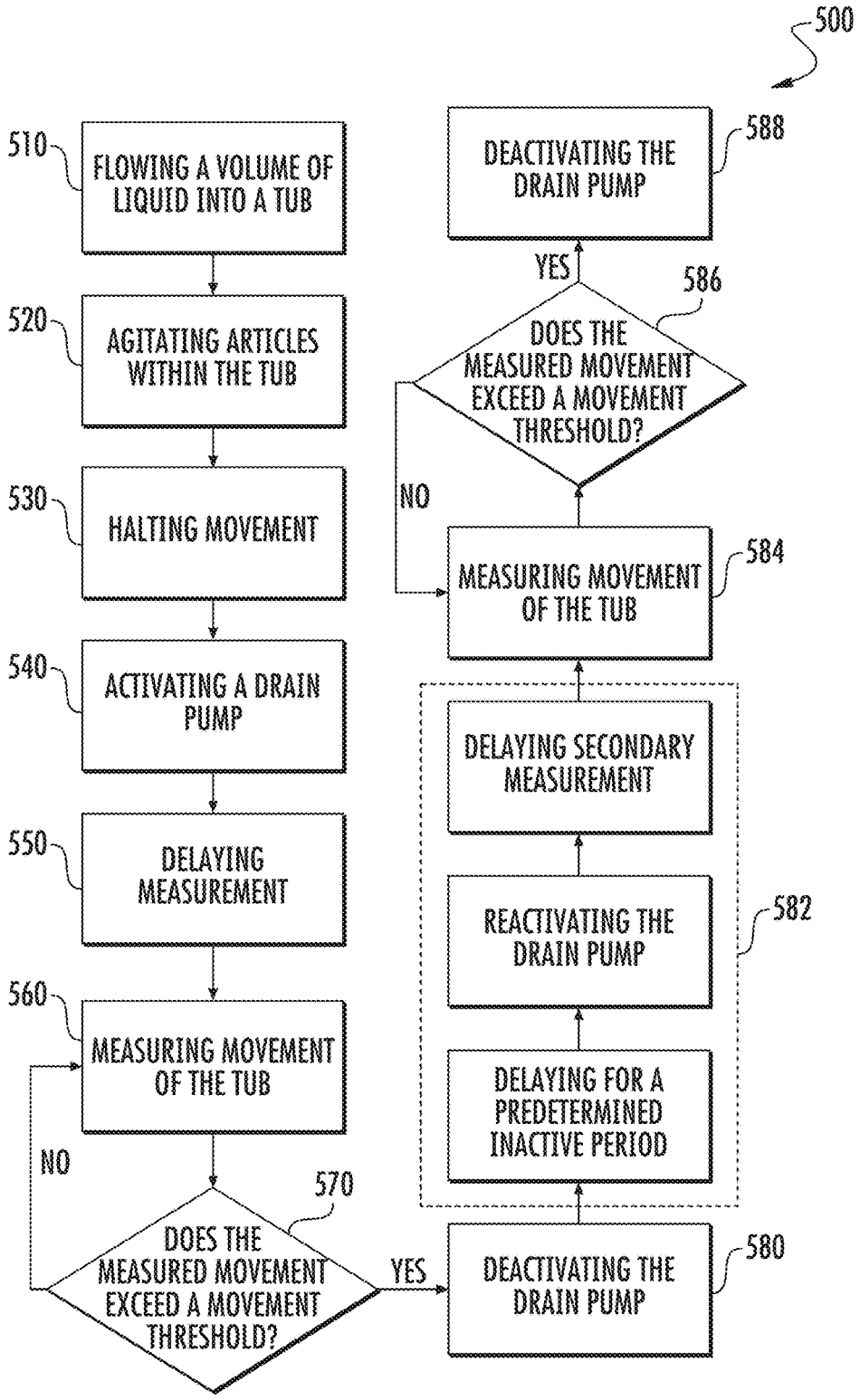
FIG. 12 provides a flow chart illustrating yet another method for operating a washing machine appliance in accordance with exemplary embodiments of the present disclosure.

Turning specifically to FIG. 12, a method 500 is illustrated. At 510, the method 500 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 520, the method 500 includes agitating articles within the tub (e.g., disposed within the wash basket) for a set period of time. Agitating may be performed by agitation element as discussed above. During such agitation, the volume of liquid flowed into the tub in step 510 remains in the tub (e.g., no drainage of liquid may occur between steps 510 and 520). Optionally, the period of time for 520 is a defined period of time programmed into the controller, and may be dependent upon the size of the load of articles and other variables that may, for example, be input by a user interacting with the control panel and input selectors thereof.

At 530, the method 500 includes halting movement within the cabinet of the washing machine appliance. In other words, the basket and agitator are prevented from moving. Thus, at 530 the agitation at 520 is stopped. However, the volume of liquid within the tub may remain. In certain embodiments, the measurement device mounted to the bottom of the tub is calibrated while the wash basket is halted. As would be understood, a zero rate or zero G-level bias at the measurement device may be offset.

At 540, the method 500 includes activating the drain pump or pump assembly to motivate at least a portion of the volume of liquid from the tub. As described above, the pump (e.g., impeller thereof) may be rotated by the motor to draw liquid (e.g., water or wash fluid) from the tub.

At 550, the method 500 includes delaying measurement following activation of the drain pump at 540. For instance, 550 may include counting down from a first pump warm-up or delay period (e.g., a predetermined span of time between 1 second and 10 seconds, such as 3 seconds). The method 500 may be prevented from continuing to step 560 until the first warm-up or delay period has expired. Additionally or alternatively, 550 may include initiating a pump confirmation sequence (e.g., as described below with respect to method 600). The method 500 may be prevented from continuing to step 560 until the pump confirmation sequence is complete. Optionally, initiation of the pump confirmation sequence may occur immediately after the warm-up or delay period has expired. In some embodiments, activation of the drain pump (e.g., step 540) continues throughout 550.

At 560, the method 500 includes measuring movement of the tub (e.g., after 550). Generally, 560 may occur during at least a portion of 540, concurrently with or subsequent to liquid within tub being pumped through the pump assembly. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 560 includes receiving a measurement signal corresponding to movement of the tub as the drain pump remains active (e.g., continues to motivate liquid from the tub).

At 570, the method 500 includes evaluating measured movement. In particular, the measured movement (e.g., the tub acceleration component or the rotation component) is compared to the movement threshold. Evaluation of 570 may be performed as the drain pump remains active. If measured movement does not exceed the movement threshold, movement may be measured again (i.e., the method 500 may return to 560). The drain pump may be maintained in an active state (e.g., to motivate or pump liquid from the tub). Optionally, 560 may be repeated (e.g., as a closed loop) such that subsequent movement measurements continue to be made as long as movement does not exceed the movement threshold. If measured movement does exceed the movement threshold, the method 500 may continue to 580.

At 580, the method 500 includes deactivating the drain pump in response to 570 (i.e., in response to determining the measured movement exceeds the movement threshold).

At 582, the method 500 includes initiating a settling sequence. For instance, 582 may include counting down from a predetermined inactive period (e.g., a predetermined span of time in excess of ten seconds, such as 11 seconds, 20 seconds, 30 seconds, etc.) following deactivation of the drain pump at 580. During the predetermined inactive period, the drain pump may thus be maintained in an inactive state. Drain pump reactivation may be prevented until the predetermined inactive period has expired. Moreover, the liquid within the tub (e.g., flowing from articles within the wash basket) may be permitted to accumulate within a lower portion of the tub at the inlet of the drain pump.

Following expiration of the predetermined inactive period, 582 may include reactivating the drain pump. As with activation, reactivation of the drain pump may motivate at least a portion of the volume of liquid from the tub. As described above, the pump (e.g., impeller thereof) may be rotated by the motor to draw liquid (e.g., water or wash fluid) from the tub.

After reactivating the drain pump, 582 may include delaying secondary measurement. For instance, additive may include counting down from a second pump warm-up or delay period (e.g., a predetermined span of time between 1 second and 10 seconds, such as 3 seconds) following reactivation of the drain pump. The method 500 may be prevented from continuing to step 584 until the warm-up or delay period has expired.

At 584, the method 500 includes again measuring movement of the tub (e.g., after 582). In turn, the measurements at 584 may be referred to as secondary measurements. Generally, 584 may occur while the drain pump remains reactivated. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 584 includes receiving a measurement signal corresponding to movement of the tub as the drain pump remains active (e.g., continues to motivate liquid from the tub).

At 586, the method 500 includes again evaluating measured movement. In particular, the secondary measured movement (e.g., the tub acceleration component or the rotation component) is compared to the movement threshold. Evaluation of 586 may be performed as the drain pump remains active. If measured movement does not exceed the movement threshold, movement may be measured again (i.e., the method 500 may return to 584). The drain pump may be maintained in an active state (e.g., to motivate or pump liquid from the tub). Optionally, 586 may be repeated (e.g., as a closed loop) such that subsequent secondary movement measurements continue to be made as long as movement does not exceed the movement threshold. If it is determined that subsequent or secondary measured movement does exceed the movement threshold, the method 500 may continue to 588.

At 588, the method 500 includes deactivating the drain pump in response to 586 (i.e., in response to determining the secondary measured movement exceeds the movement threshold).

Figure 13:
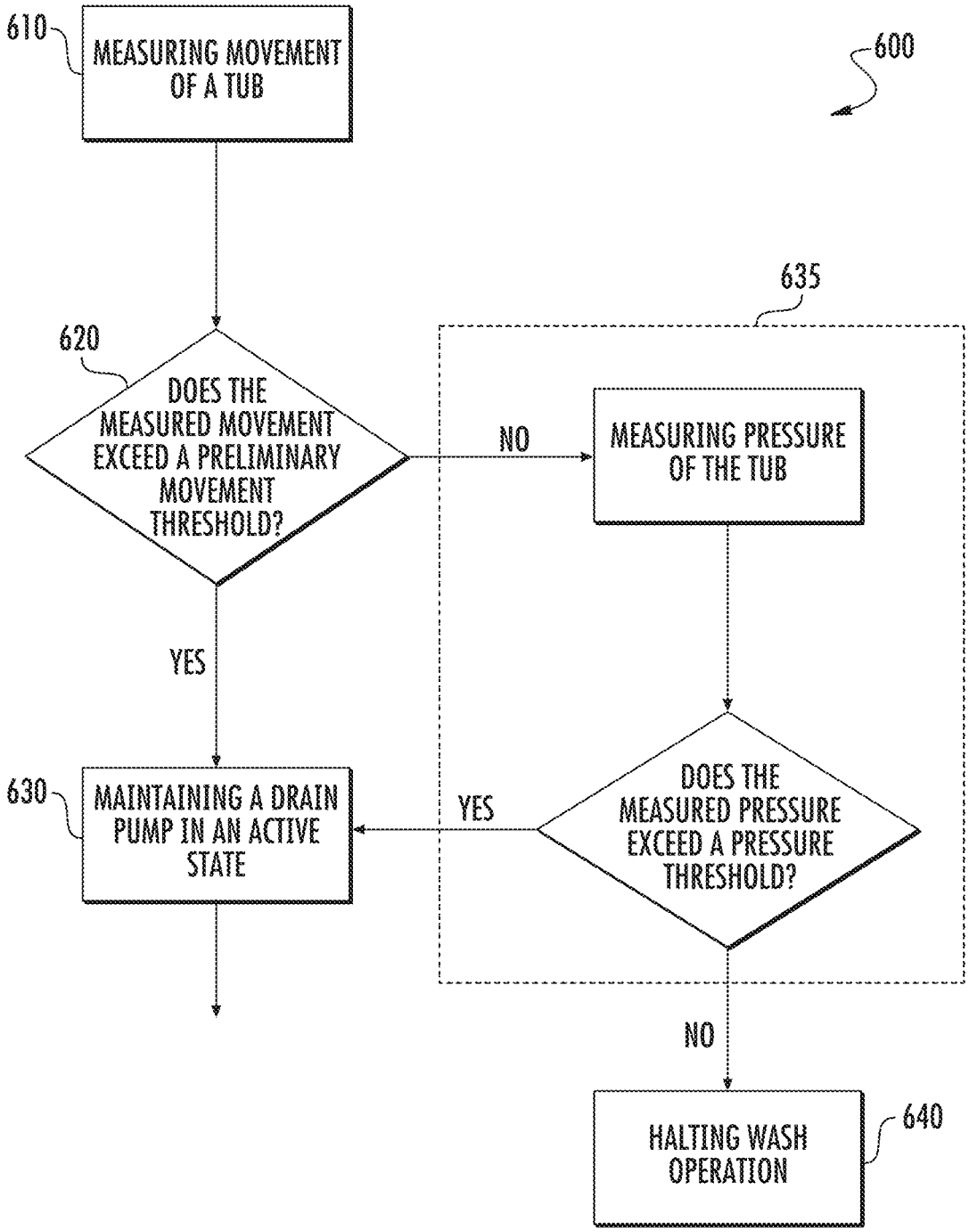
FIG. 13 provides a flow chart illustrating yet another method for operating a washing machine appliance in accordance with exemplary embodiments of the present disclosure.

Turning specifically to FIG. 13, a method 600 is illustrated. As would be understood, method 600 may continue within or as part of another washing operation, such as another exemplary method described herein.

At 610, the method 600 includes measuring movement of the tub after the drain pump has been activated. In other words, movement of the tub may be measured as the drain pump motivates or pumps liquid from the tub. Optionally, the movement measured at 610 may be a preliminary movement immediately following activation of the drain pump. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, he 10 includes receiving a preliminary measurement signal corresponding to movement of the tub as the drain pump remains active (e.g., continues to motivate liquid from the tub).

At 620, the method 600 includes evaluating measured movement. In particular, the measured movement (e.g., the tub acceleration component or the rotation component) is compared to a preliminary movement threshold. Evaluation of 620 may be performed as the drain pump remains active. If measured movement does exceed the limit movement threshold, the method 600 may proceed to 630, which includes maintaining the drain pump in an active state (e.g., such that the drain pump continues to motivate liquid from the tub). Measured movement does not exceed the number movement threshold, method 600 may proceed to 635.

At 635, the method 600 includes evaluating pressure within the tub. In particular, 635 includes measuring pressure (e.g., liquid pressure) within the tub. Generally, 635 may occur while the drain pump remains inactive. For instance, as described above, multiple signals may be received from the pressure sensor at a bottom portion of the tub. One or more signals from the pressure sensor may be compared to a pressure threshold. The pressure threshold may be a specific value or value range of pressure (e.g., in pounds per square inch) or, alternatively, a rate of change of pressure (e.g., the slope value of pressure values over time). In exemplary embodiments, multiple signals may be received at multiple points in time, such that a trend (e.g., increasing or decreasing) of the liquid pressure may be established. If measured pressure is decreasing, the method 600 may proceed to 630. If measured pressure is not decreasing, method 600 may proceed to 640, which includes halting a washing operation of the washing machine appliance. In particular, the drain pump may be deactivated at 640. Advantageously, the method 600 may prevent continued activation of the drain pump if an error has occurred at the drain pump (e.g., such that liquid is not being motivated from the tub).

Figure 14:
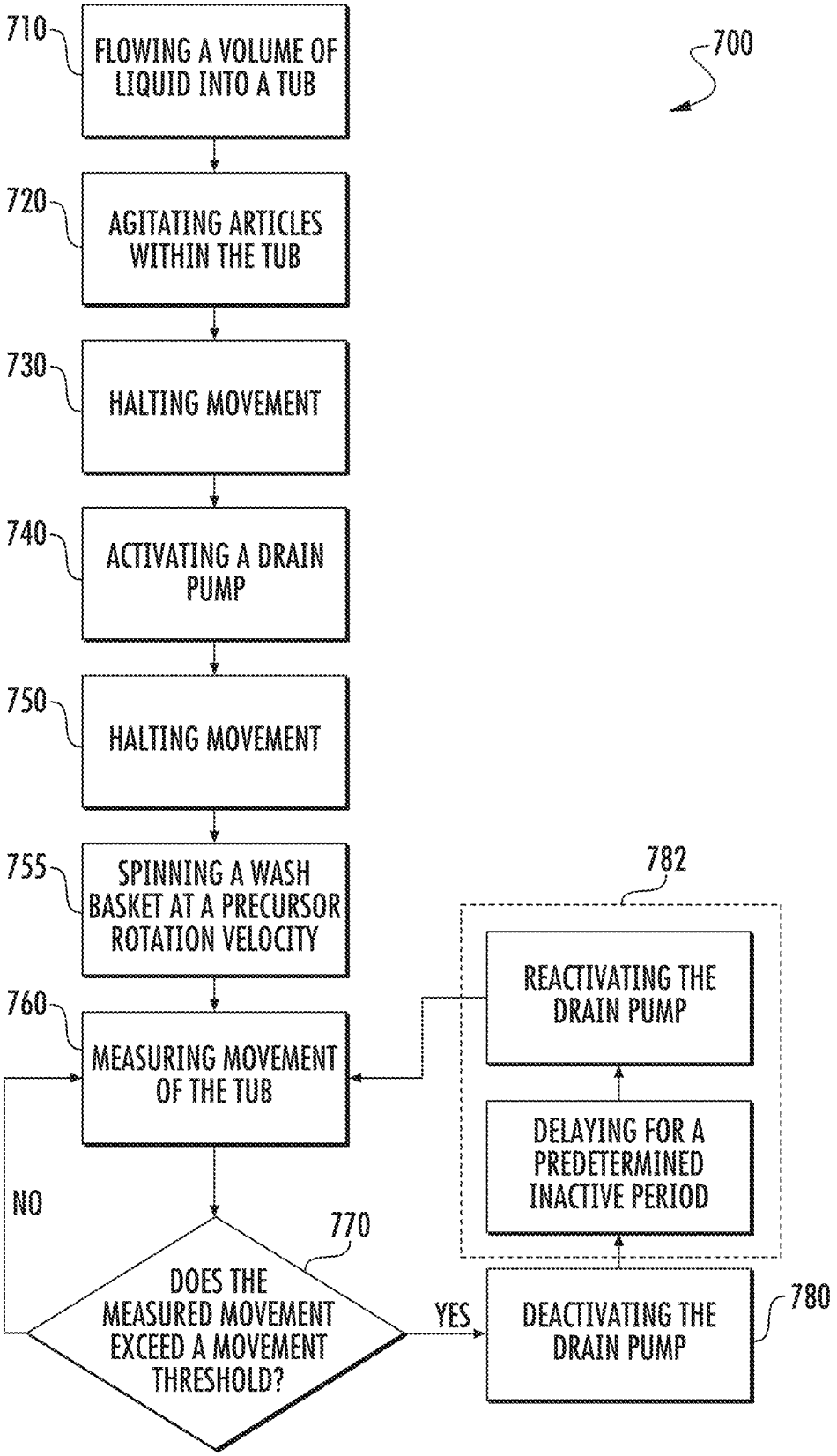
FIG. 14 provides a flow chart illustrating yet another method for operating a washing machine appliance in accordance with exemplary embodiments of the present disclosure.

Turning specifically to FIG. 14, a method 700 is illustrated. At 710, the method 700 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 720, the method 700 includes agitating articles within the tub (e.g., disposed within the wash basket) for a set period of time. Agitating may be performed by agitation element as discussed above. During such agitation, the volume of liquid flowed into the tub in step 710 remains in the tub (e.g., no drainage of liquid may occur between steps 710 and 720). Optionally, the period of time for 720 is a defined period of time programmed into the controller, and may be dependent upon the size of the load of articles and other variables that may, for example, be input by a user interacting with the control panel and input selectors thereof.

At 730, the method 700 includes halting movement within the cabinet of the washing machine appliance. In other words, the basket and agitator are prevented from moving. Thus, at 730 the agitation at 720 is stopped. However, the volume of liquid within the tub may remain. In certain embodiments, the measurement device mounted to the bottom of the tub is calibrated while the wash basket is halted. As would be understood, a zero rate or zero G-level bias at the measurement device may be offset.

At 740, the method 700 includes activating the drain pump or pump assembly to motivate at least a portion of the volume of liquid from the tub. As described above, the pump (e.g., impeller thereof) may be rotated by the motor to draw liquid (e.g., water or wash fluid) from the tub.

At 750, the method 700 includes delaying measurement following activation of the drain pump at 740. For instance, 750 may include counting down from a first pump warm-up or delay period (e.g., a predetermined span of time between 1 second and 10 seconds, such as 3 seconds). The method 700 may be prevented from continuing to step 760 until the first warm-up or delay period has expired. Additionally or alternatively, 750 may include initiating a pump confirmation sequence (e.g., as described above with respect to method 600). The method 700 may be prevented from continuing to step 760 until the pump confirmation sequence is complete. Optionally, initiation of the pump confirmation sequence may occur immediately after the warm-up or delay period has expired. In some embodiments, activation of the drain pump (e.g., step 740) continues throughout 750.

At 755, the method 700 includes spinning the wash basket at a precursor rotation velocity (e.g., while the drain pump is active). In certain embodiments, 755 begins after activating the drain pump (e.g., subsequent to the start of 740). In additional or alternative embodiments, spinning at 755 begins prior to the start of 740 (e.g., while the drain pump is active). During at least a portion of 755, the drain pump may continue to operate such that the impeller is rotated to motivate water from the tub. Generally, precursor rotation velocity is a predetermined velocity [e.g., in rotations per minute (RPM)] for rotating the wash basket about the rotation axis. Moreover, the precursor rotation velocity may be a sub-shedding velocity (e.g., above 5 RPM). In other words, the precursor rotation velocity may be a velocity at which articles within the wash basket would not be fully plastered to the sidewalls of the wash basket. In certain embodiments, precursor rotation velocity is less than 1000 RPM.

In optional embodiments, multiple precursor rotation velocities are provided. In some such embodiments, 755 includes spinning the wash basket at progressively higher precursor rotation velocities. As an example, three or more progressively higher precursor rotation velocities may be provided (e.g., 140 RPM, 450 RPM, 800 RPM). In some such embodiments, the wash basket spins at 140 RPM for a set period. The wash basket may then spin at 450 RPM for another set period. Subsequent to spinning at 450 RPM (and thereby subsequent to spinning at 140 RPM), the wash basket may spin at 800 RPM for yet another set period. Optionally, each of the set periods may include a predetermined span of time (e.g., in seconds). Additionally or alternatively, each of the set periods may be equal to each other.

At 760, the method 700 includes measuring movement of the tub (e.g., after 750). Generally, 760 may occur during at least a portion of 740, concurrently with or subsequent to liquid within tub being pumped through the pump assembly. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 760 includes receiving a measurement signal corresponding to movement of the tub as the drain pump remains active (e.g., continues to motivate liquid from the tub).

At 770, the method 700 includes evaluating measured movement. In particular, the measured movement (e.g., the tub acceleration component or the rotation component) is compared to the movement threshold. Evaluation of 770 may be performed as the drain pump remains active. If measured movement does not exceed the movement threshold, movement may be measured again (i.e., the method 700 may return to 760). The drain pump may be maintained in an active state (e.g., to motivate or pump liquid from the tub). Optionally, 760 may be repeated (e.g., as a closed loop)

such that subsequent movement measurements continue to be made as long as movement does not exceed the movement threshold. If measured movement does exceed the movement threshold, the method 700 may continue to 780.

At 780, the method 700 includes deactivating the drain pump in response to 770 (i.e., in response to determining the measured movement exceeds the movement threshold).

At 782, the method 700 includes initiating a settling sequence. For instance, 782 may include counting down from a predetermined inactive period (e.g., a predetermined span of time in excess of ten seconds, such as 11 seconds, 20 seconds, 30 seconds, etc.) following deactivation of the drain pump at 780. During the predetermined inactive period, the drain pump may thus be maintained in an inactive state. Drain pump reactivation may be prevented until the predetermined inactive period has expired. Moreover, the liquid within the tub (e.g., flowing from articles within the wash basket) may be permitted to accumulate within a lower portion of the tub at the inlet of the drain pump.

Following expiration of the predetermined inactive period, 782 may include reactivating the drain pump. As with activation, reactivation of the drain pump may motivate at least a portion of the volume of liquid from the tub. As described above, the pump (e.g., impeller thereof) may be rotated by the motor to draw liquid (e.g., water or wash fluid) from the tub.

After reactivating the drain pump, 782 may again measure movement of the tub (i.e., the method 700 may return to 760). The drain pump may be maintained in an active state (e.g., to motivate or pump liquid from the tub).

Figure 15:
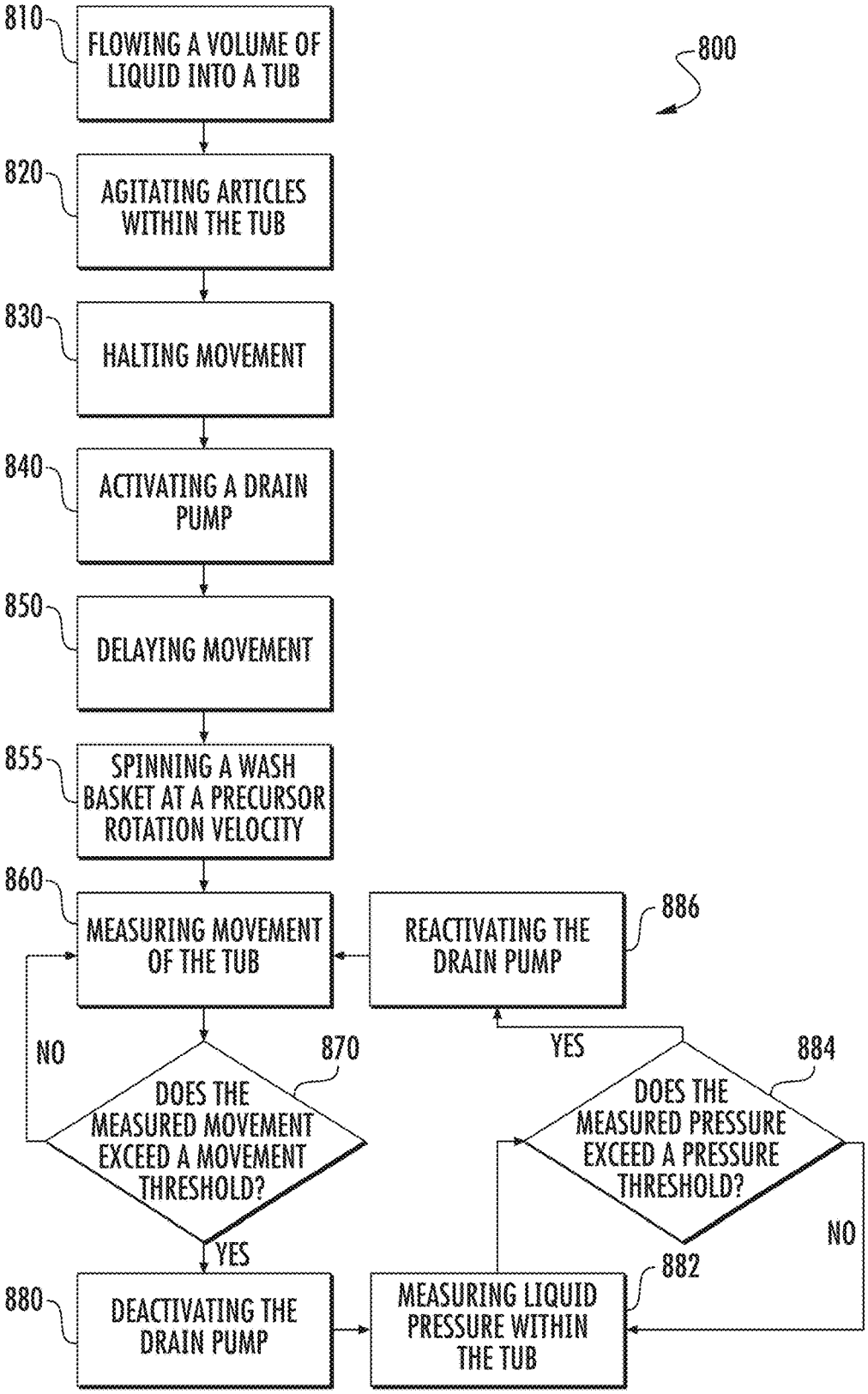
FIG. 15 provides a flow chart illustrating yet another method for operating a washing machine appliance in accordance with exemplary embodiments of the present disclosure.

Turning specifically to FIG. 15, a method 800 is illustrated. At 810, the method 800 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 820, the method 800 includes agitating articles within the tub (e.g., disposed within the wash basket) for a set period of time. Agitating may be performed by agitation element as discussed above. During such agitation, the volume of liquid flowed into the tub in step 810 remains in the tub (e.g., no drainage of liquid may occur between steps 810 and 820). Optionally, the period of time for 820 is a defined period of time programmed into the controller, and may be dependent upon the size of the load of articles and other variables that may, for example, be input by a user interacting with the control panel and input selectors thereof.

At 830, the method 800 includes halting movement within the cabinet of the washing machine appliance. In other words, the basket and agitator are prevented from moving. Thus, at 830 the agitation at 820 is stopped. However, the volume of liquid within the tub may remain. In certain embodiments, the measurement device mounted to the bottom of the tub is calibrated while the wash basket is halted. As would be understood, a zero rate or zero G-level bias at the measurement device may be offset.

At 840, the method 800 includes activating the drain pump or pump assembly to motivate at least a portion of the volume of liquid from the tub. As described above, the pump (e.g., impeller thereof) may be rotated by the motor to draw liquid (e.g., water or wash fluid) from the tub.

At 850, the method 800 includes delaying measurement following activation of the drain pump at 840. For instance, 850 may include counting down from a first pump warm-up or delay period (e.g., a predetermined span of time between 1 second and 10 seconds, such as 3 seconds). The method 800 may be prevented from continuing to step 860 until the first warm-up or delay period has expired. Additionally or alternatively, 850 may include initiating a pump confirmation sequence (e.g., as described above with respect to method 600). The method 800 may be prevented from continuing to step 860 until the pump confirmation sequence is complete. Optionally, initiation of the pump confirmation sequence may occur immediately after the warm-up or delay period has expired. In some embodiments, activation of the drain pump (e.g., step 840) continues throughout 850.

At 855, the method 800 includes spinning the wash basket at a precursor rotation velocity (e.g., while the drain pump is active). In certain embodiments, 855 begins after activating the drain pump (e.g., subsequent to the start of 840). In additional or alternative embodiments, spinning at 855 begins prior to the start of 840, but continues subsequent to the start of 840 (e.g., while the drain pump is active). During at least a portion of 855, the drain pump may continue to operate such that the impeller is rotated to motivate water from the tub. Generally, precursor rotation velocity is a predetermined velocity [e.g., in rotations per minute (RPM)] for rotating the wash basket about the rotation axis. Moreover, the precursor rotation velocity may be a sub-shedding velocity (e.g., above 5 RPM). In other words, the precursor rotation velocity may be a velocity at which articles within the wash basket would not be fully plastered to the sidewalls of the wash basket. In certain embodiments, precursor rotation velocity is less than 1000 RPM.

In optional embodiments, multiple precursor rotation velocities are provided. In some such embodiments, 855 includes spinning the wash basket at progressively higher precursor rotation velocities. As an example, three or more progressively higher precursor rotation velocities may be provided (e.g., 140 RPM, 450 RPM, 800 RPM). In some such embodiments, the wash basket spins at 140 RPM for a set period. The wash basket may then spin at 450 RPM for another set period. Subsequent to spinning at 450 RPM (and thereby subsequent to spinning at 140 RPM), the wash basket may spin at 800 RPM for yet another set period. Optionally, each of the set periods may include a predetermined span of time (e.g., in seconds). Additionally or alternatively, each of the set periods may be equal to each other.

At 860, the method 800 includes measuring movement of the tub (e.g., after 850). Generally, 860 may occur during at least a portion of 840, concurrently with or subsequent to liquid within tub being pumped through the pump assembly. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 860 includes receiving a measurement signal corresponding to movement of the tub as the drain pump remains active (e.g., continues to motivate liquid from the tub).

At 870, the method 800 includes evaluating measured movement. In particular, the measured movement (e.g., the tub acceleration component or the rotation component) is compared to the movement threshold. Evaluation of 870 may be performed as the drain pump remains active. If measured movement does not exceed the movement threshold, movement may be measured again (i.e., the method 800 may return to 860). The drain pump may be maintained in an active state (e.g., to motivate or pump liquid from the tub). Optionally, 860 may be repeated (e.g., as a closed loop) such that subsequent movement measurements continue to be made as long as movement does not exceed the movement threshold. If measured movement does exceed the movement threshold, the method 800 may continue to 880.

At 880, the method 800 includes deactivating the drain pump in response to 870 (i.e., in response to determining the measured movement exceeds the movement threshold).

At 882, the method 800 includes measuring pressure (e.g., liquid pressure) within the tub. Generally, 882 may occur during at least a portion of 880, after the drain pump is deactivated and while the drain pump remains inactive. For instance, as described above, one or more signals may be received from the pressure sensor.

At 884, the method 800 includes evaluating the measured pressure. In particular, the measured pressure is compared to a pressure threshold. The evaluation of 884 may be performed as the drain pump remains inactive. If measured pressure does not exceed the pressure threshold, pressure may be measured again (i.e., the method 800 may return to 882). The drain pump may be maintained in an inactive state (e.g., to prevent the impeller of the drain pump from being rotated or activated). Optionally, 884 may be repeated (e.g., as a closed loop) such that subsequent pressure measurements continue to be made as long as pressure does not exceed the pressure threshold. If measured pressure does exceed the pressure threshold, the method 800 may continue to 886.

At 886, the method 800 includes reactivating the drain pump. In particular, 886 may be performed in response to determining the measured pressure does exceed the pressure threshold. As with activation, reactivation of the drain pump may motivate at least a portion of the volume of liquid from the tub. As described above, the pump (e.g., impeller thereof) may be rotated by the motor to draw liquid (e.g., water or wash fluid) from the tub.

After reactivating the drain pump, the method 800 may again measure movement of the tub (i.e., the method 800 may return to 860). The drain pump may be maintained in an active state (e.g., to motivate or pump liquid from the tub).

Optionally, the new measurement (i.e., return to 860) may be delayed after reactivating the drain pump at 886. For instance, the method 800 may include counting down from a new pump warm-up or delay period (e.g., a predetermined span of time between 1 second and 10 seconds, such as 3 seconds) following 886. The method 800 may be prevented from returning to step 860 until the new warm-up or delay period has expired.

Figure 16:
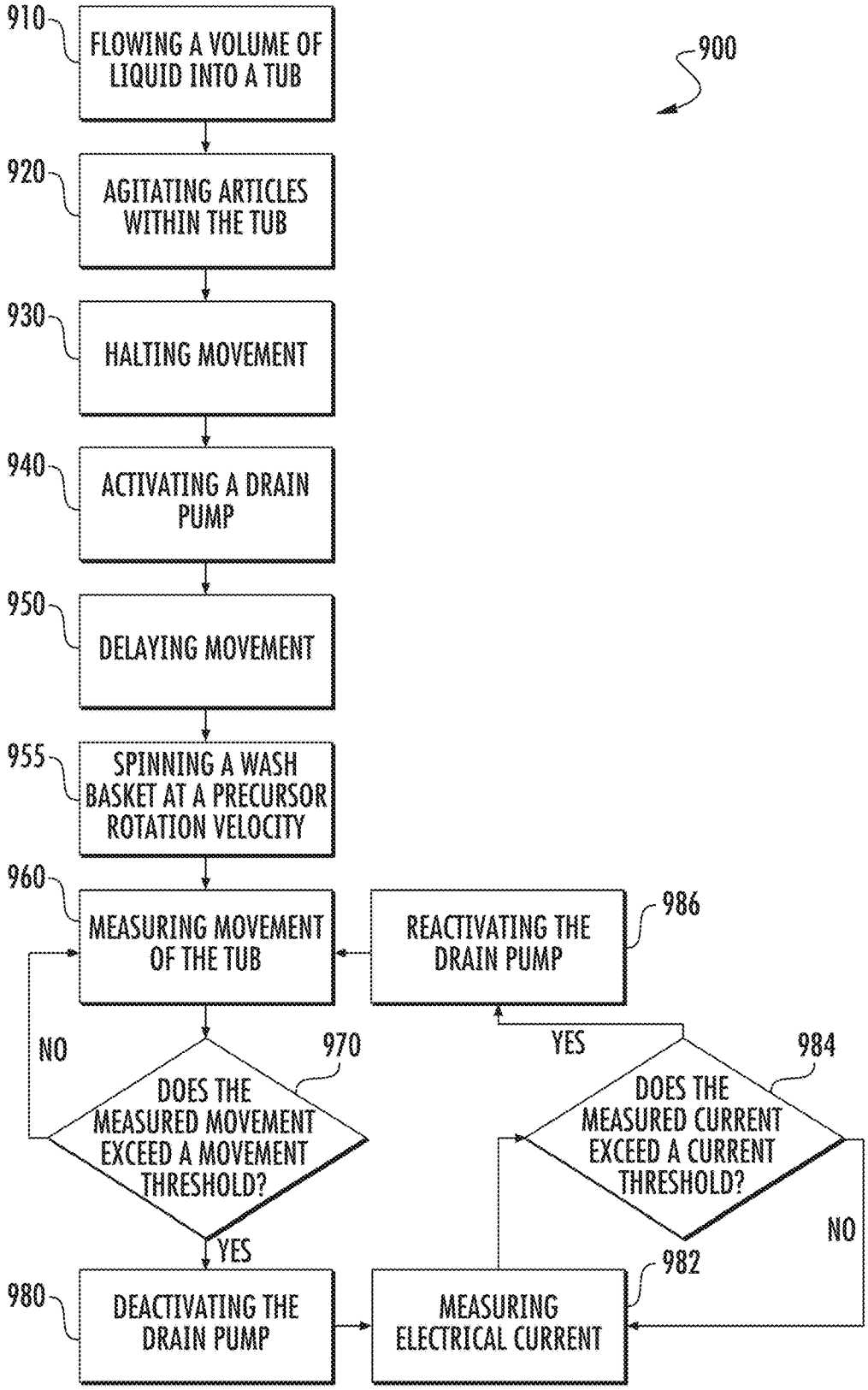
FIG. 16 provides a flow chart illustrating yet another method for operating a washing machine appliance in accordance with exemplary embodiments of the present disclosure.

Turning specifically to FIG. 16, a method 900 is illustrated. At 910, the method 900 includes flowing a volume of liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 920, the method 900 includes agitating articles within the tub (e.g., disposed within the wash basket) for a set period of time. Agitating may be performed by agitation element as discussed above. During such agitation, the volume of liquid flowed into the tub in step 910 remains in the tub (e.g., no drainage of liquid may occur between steps 910 and 920). Optionally, the period of time for 920 is a defined period of time programmed into the controller, and may be dependent upon the size of the load of articles and other variables that may, for example, be input by a user interacting with the control panel and input selectors thereof.

At 930, the method 900 includes halting movement within the cabinet of the washing machine appliance. In other words, the basket and agitator are prevented from moving. Thus, at 930 the agitation at 920 is stopped. However, the volume of liquid within the tub may remain. In certain embodiments, the measurement device mounted to the bottom of the tub is calibrated while the wash basket is halted. As would be understood, a zero rate or zero G-level bias at the measurement device may be offset.

At 940, the method 900 includes activating the drain pump or pump assembly to motivate at least a portion of the volume of liquid from the tub. As described above, the pump (e.g., impeller thereof) may be rotated by the motor to draw liquid (e.g., water or wash fluid) from the tub.

At 950, the method 900 includes delaying measurement following activation of the drain pump at 940. For instance, 950 may include counting down from a first pump warm-up or delay period (e.g., a predetermined span of time between 1 second and 10 seconds, such as 3 seconds). The method 900 may be prevented from continuing to step 960 until the first warm-up or delay period has expired. Additionally or alternatively, 950 may include initiating a pump confirmation sequence (e.g., as described above with respect to method 600). The method 900 may be prevented from continuing to step 960 until the pump confirmation sequence is complete. Optionally, initiation of the pump confirmation sequence may occur immediately after the warm-up or delay period has expired. In some embodiments, activation of the drain pump (e.g., step 940) continues throughout 950.

At 955, the method 900 includes spinning the wash basket at a precursor rotation velocity. In particular, 955 begins after activating the drain pump (e.g., subsequent to the start of 955). In some such embodiments, the drain pump continues to operate such that the impeller is rotated to motivate water from the tub. Generally, precursor rotation velocity is a predetermined velocity [e.g., in rotations per minute (RPM)] for rotating the wash basket about the rotation axis. Moreover, the precursor rotation velocity may be a sub-shedding velocity. In other words, the precursor rotation velocity may be a velocity at which articles within the wash basket would not be fully plastered to the sidewalls of the wash basket. In certain embodiments, precursor rotation velocity is less than 1000 RPM.

In optional embodiments, multiple precursor rotation velocities are provided. In some such embodiments, 955 includes spinning the wash basket at progressively higher precursor rotation velocities. As an example, three or more progressively higher precursor rotation velocities may be provided (e.g., 140 RPM, 450 RPM, 800 RPM). In some such embodiments, the wash basket spins at 140 RPM for a set period. The wash basket may then spin at 450 RPM for another set period. Subsequent to spinning at 450 RPM (and thereby subsequent to spinning at 140 RPM), the wash basket may spin at 800 RPM for yet another set period. Optionally, each of the set periods may include a predetermined span of time (e.g., in seconds). Additionally or alternatively, each of the set periods may be equal to each other.

At 960, the method 900 includes measuring movement of the tub (e.g., after 950). Generally, 960 may occur during at least a portion of 940, concurrently with or subsequent to liquid within tub being pumped through the pump assembly. As described above, measured movement may have one or more components (e.g., rotation component or acceleration component) detected at a suitable measurement device, such as an optical sensor, an inductive sensor, a Hall Effect sensor, a potentiometer, a load cell, a strain gauge, a gyroscope, or an accelerometer. In turn, 960 includes receiving a measurement signal corresponding to movement of the tub as the drain pump remains active (e.g., continues to motivate liquid from the tub).

At 970, the method 900 includes evaluating measured movement. In particular, the measured movement (e.g., the tub acceleration component or the rotation component) is compared to the movement threshold. Evaluation of 970 may be performed as the drain pump remains active. If measured movement does not exceed the movement threshold, movement may be measured again (i.e., the method 900 may return to 960). The drain pump may be maintained in an active state (e.g., to motivate or pump liquid from the tub). Optionally, 960 may be repeated (e.g., as a closed loop) such that subsequent movement measurements continue to be made as long as movement does not exceed the movement threshold. If measured movement does exceed the movement threshold, the method 900 may continue to 980.

At 980, the method 900 includes deactivating the drain pump in response to 970 (i.e., in response to determining the measured movement exceeds the movement threshold).

At 982, the method 900 includes measuring electrical motor current or amperage at the motor rotating the wash basket. Generally, 982 may occur during at least a portion of 980, after the drain pump is deactivated and while the drain pump remains inactive. For instance, as described above, one or more signals may be received from the motor assembly.

At 984, the method 900 includes evaluating measured electrical current. In particular, the measured electrical current is compared to a current threshold. The evaluation of 984 may be performed as the drain pump remains inactive. If measured electrical current does not exceed the current threshold, the current may be measured again (i.e., the method 900 may return to 982). The drain pump may be maintained in an inactive state (e.g., to prevent the impeller of the drain pump from being rotated or activated). Optionally, 984 may be repeated (e.g., as a closed loop) such that subsequent motor current measurements continue to be made as long as the current does not exceed the current threshold. If measured electrical current does exceed the current threshold, the method 900 may continue to 986.

At 986, the method 900 includes reactivating the drain pump. In particular, 986 may be performed in response to determining the measured electrical current does exceed the current threshold. As with activation, reactivation of the drain pump may motivate at least a portion of the volume of liquid from the tub. As described above, the pump (e.g., impeller thereof) may be rotated by the motor to draw liquid (e.g., water or wash fluid) from the tub.

After reactivating the drain pump, the method 900 may again measure movement of the tub (i.e., the method 900 may return to 960). The drain pump may be maintained in an active state (e.g., to motivate or pump liquid from the tub).

Optionally, the new measurement (i.e., return to 960) may be delayed after reactivating the drain pump at 986. For instance, the method 900 may include counting down from a new pump warm-up or delay period (e.g., a predetermined span of time between 1 second and 10 seconds, such as 3 seconds) following 986. The method 900 may be prevented from returning to step 960 until the new warm-up or delay period has expired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a tub;
- a basket rotatably mounted within the tub;
- a nozzle in fluid communication with the tub to selectively flow liquid thereto;
- a measurement device mounted to the tub, the measurement device comprising an accelerometer, a gyroscope, an optical sensor, an inductive sensor, a Hall Effect sensor, a potentiometer, a load cell, or a strain gauge;
- a motor in mechanical communication with the basket to selectively rotate the basket within the tub;
- a drain pump in fluid communication with the tub to selectively motivate wash fluid therefrom; and
- a controller in operative communication with the measurement device, the motor, and the drain pump, the controller being configured to initiate a washing operation, the washing operation comprising
  - flowing a volume of liquid into the tub,
  - activating the drain pump for an active pumping period to motivate at least a portion of the volume of liquid from the tub,
  - measuring movement of the tub during the active pumping period,
  - determining the measured movement exceeds a movement threshold,
  - deactivating the drain pump in response to determining the measured movement exceeds the movement threshold,
  - measuring liquid pressure within the tub after deactivating the drain pump,
  - determining the measured liquid pressure exceeds a pressure threshold, and
  - reactivating the drain pump in response to determining the measured liquid pressure exceeds the pressure threshold.

2. The washing machine appliance of claim 1, wherein the measured movement is a second measured movement, wherein the washing operation further comprises
- determining a first measured movement does not exceed the movement threshold prior to determining the second measured movement exceeds the movement threshold, and
- maintaining activation of the drain pump in response to determining the first measured movement does not exceed the movement threshold.

3. The washing machine appliance of claim 1, wherein the measured movement comprises a tub acceleration component, wherein the movement threshold comprises a predetermined acceleration value, and wherein the determining the measured movement exceeds the movement threshold comprises comparing the tub acceleration component to the predetermined acceleration value.

4. The washing machine appliance of claim 1, wherein the measured movement comprises a rotation component, wherein the movement threshold comprises a predetermined rotation threshold value, and wherein the determining the measured movement exceeds the movement threshold comprises comparing the rotation component to the predetermined rotation threshold value.

5. The washing machine appliance of claim 1, wherein the measured movement is a second measured movement, and wherein the washing operation further comprises measuring preliminary movement in response to activating the drain pump and prior to measuring the second measured movement, determining the measured preliminary movement exceeds a predetermined preliminary movement threshold, and maintaining activation of the drain pump in response to determining the measured preliminary movement exceeds the predetermined preliminary movement threshold.

6. The washing machine appliance of claim 1, wherein the washing operation further comprises spinning the basket at a precursor rotation velocity after activating the drain pump, wherein measuring movement occurs during spinning.

7. The washing machine appliance of claim 1, wherein the washing operation further comprises spinning the basket at a shedding rotation velocity in response to determining the measured movement exceeds the movement threshold.

8. A washing machine appliance comprising:

a tub;

a basket rotatably mounted within the tub;

a nozzle in fluid communication with the tub to selectively flow liquid thereto;

a measurement device mounted to the tub, the measurement device comprising an accelerometer, a gyroscope, an optical sensor, an inductive sensor, a Hall Effect sensor, a potentiometer, a load cell, or a strain gauge;

a motor in mechanical communication with the basket to selectively rotate the basket within the tub;

a drain pump in fluid communication with the tub to selectively motivate wash fluid therefrom; and a controller in operative communication with the measurement device, the motor, and the drain pump, the controller being configured to initiate a washing operation, the washing operation comprising flowing a volume of liquid into the tub, activating the drain pump for an active pumping period to motivate at least a portion of the volume of liquid from the tub, measuring movement of the tub during the active pumping period, determining the measured movement exceeds a movement threshold, deactivating the drain pump in response to determining the measured movement exceeds the movement threshold, measuring electrical current at the motor in mechanical communication with the basket after deactivating the drain pump, determining the measured electrical current exceeds an electrical current threshold, and reactivating the drain pump in response to determining the measured electrical current exceeds the electrical current threshold.

9. The washing machine appliance of claim 8, wherein the measured movement is a second measured movement, wherein the washing operation further comprises determining a first measured movement does not exceed the movement threshold prior to determining the second measured movement exceeds the movement threshold, and maintaining activation of the drain pump in response to determining the first measured movement does not exceed the movement threshold.

10. The washing machine appliance of claim 8, wherein the measured movement comprises a tub acceleration component, wherein the movement threshold comprises a predetermined acceleration value, and wherein the determining the measured movement exceeds the movement threshold comprises comparing the tub acceleration component to the predetermined acceleration value.

11. The washing machine appliance of claim 8, wherein the measured movement comprises a rotation component, wherein the movement threshold comprises a predetermined rotation threshold value, and wherein the determining the measured movement exceeds the movement threshold comprises comparing the rotation component to the predetermined rotation threshold value.

12. The washing machine appliance of claim 8, wherein the measured movement is a second measured movement, and wherein the washing operation further comprises measuring preliminary movement in response to activating the drain pump and prior to measuring the second measured movement, determining the measured preliminary movement exceeds a predetermined preliminary movement threshold, and maintaining activation of the drain pump in response to determining the measured preliminary movement exceeds the predetermined preliminary movement threshold.

13. The washing machine appliance of claim 8, wherein the washing operation further comprises spinning the basket at a precursor rotation velocity after activating the drain pump, wherein measuring movement occurs during spinning.

14. The washing machine appliance of claim 8, wherein the washing operation further comprises spinning the basket at a shedding rotation velocity in response to determining the measured movement exceeds the movement threshold.

15. A washing machine appliance comprising:

a tub;

a basket rotatably mounted within the tub;

a nozzle in fluid communication with the tub to selectively flow liquid thereto;

a measurement device mounted to the tub, the measurement device comprising an accelerometer, a gyroscope, an optical sensor, an inductive sensor, a Hall Effect sensor, a potentiometer, a load cell, or a strain gauge;

a motor in mechanical communication with the basket to selectively rotate the basket within the tub;

a drain pump in fluid communication with the tub to selectively motivate wash fluid therefrom; and a controller in operative communication with the measurement device, the motor, and the drain pump, the controller being configured to initiate a washing operation, the washing operation comprising flowing a volume of liquid into the tub, activating the drain pump for an active pumping period to motivate at least a portion of the volume of liquid from the tub, measuring preliminary movement in response to activating the drain pump, determining the measured preliminary movement exceeds a predetermined preliminary movement threshold, maintaining activation of the drain pump in response to determining the measured preliminary movement exceeds the predetermined preliminary movement threshold, measuring subsequent movement of the tub during the active pumping period after determining the measured preliminary movement exceeds the predetermined preliminary movement threshold, determining the subsequent measured movement exceeds a movement threshold, and deactivating the drain pump in response to determining the subsequent measured movement exceeds the movement threshold.

16. The washing machine appliance of claim 15, wherein deactivation of the drain pump is maintained for a predetermined inactive period, and wherein the washing operation further comprises reactivating the drain pump for a secondary active pumping period immediately following the predetermined inactive period, measuring subsequent movement of the tub during the secondary active pumping period, determining whether the measured subsequent movement exceeds the movement threshold, and deactivating the drain pump in response to determining the measured subsequent movement exceeds the movement threshold.

17. The washing machine appliance of claim 15, wherein the subsequent measured movement comprises a tub acceleration component, wherein the movement threshold comprises a predetermined acceleration value, and wherein the determining the subsequent measured movement exceeds the movement threshold comprises comparing the tub acceleration component to the predetermined acceleration value.

18. The washing machine appliance of claim 15, wherein the subsequent measured movement comprises a rotation component, wherein the movement threshold comprises a predetermined rotation threshold value, and wherein the determining the subsequent measured movement exceeds the movement threshold comprises comparing the rotation component to the predetermined rotation threshold value.

19. The washing machine appliance of claim 15, wherein the washing operation further comprises spinning the basket at a precursor rotation velocity after activating the drain pump, wherein measuring subsequent movement occurs during spinning.

20. The washing machine appliance of claim 15, wherein the washing operation further comprises spinning the basket at a shedding rotation velocity in response to determining the subsequent measured movement exceeds the movement threshold.

* * * * *